US006683587B2

(12) United States Patent
Gulsen

(10) Patent No.: US 6,683,587 B2
(45) Date of Patent: Jan. 27, 2004

(54) SWITCHED MODE DIGITAL LOGIC METHOD, SYSTEM AND APPARATUS FOR DIRECTLY DRIVING LCD GLASS

(75) Inventor: John K. Gulsen, Aliso Viejo, CA (US)

(73) Assignee: Microchip Technology Incorporated, Chandler, AZ (US)

( * ) Notice: Subject to any disclaimer, the term of this patent is extended or adjusted under 35 U.S.C. 154(b) by 164 days.

(21) Appl. No.: 09/919,512

(22) Filed: Jul. 31, 2001

(65) Prior Publication Data

US 2003/0080929 A1 May 1, 2003

(51) Int. Cl.[7] ..... G09G 3/18
(52) U.S. Cl. ..... 345/38; 345/34; 345/53
(58) Field of Search ..... 345/33, 38, 42, 345/48, 101, 50–54, 94, 98–99

(56) References Cited

U.S. PATENT DOCUMENTS 4,205,516 A * 6/1980 Terao ..... 368/29
5,874,931 A * 2/1999 Drake et al. ..... 345/51
5,952,985 A * 9/1999 McKinney et al. ..... 345/42
6,297,789 B2 * 10/2001 Gauthier et al. ..... 345/87
6,313,821 B1 * 11/2001 Mizuno ..... 345/101
6,317,110 B1 * 11/2001 Brandt ..... 345/87
6,339,413 B1 * 1/2002 Drake et al. ..... 345/50

* cited by examiner

*Primary Examiner*—Richard Hjerpe
*Assistant Examiner*—Duc Q Dinh
(74) *Attorney, Agent, or Firm*—Baker Botts L.L.P.

(57) ABSTRACT

A digital circuit having a plurality of digital outputs coupled to backplane(s) and segments of a LCD glass in combination with a software program functions as a "switched mode" LCD driver. Alternating in polarity but equal in magnitude RMS voltage pulses are applied between segments and backplane(s) of the LCD glass. The voltage amplitude and time duration of these pulses determine whether a LCD segment is opaque or clear and the overall contrast of the LCD.

46 Claims, 7 Drawing Sheets

SWITCHED MODE DIGITAL LOGIC METHOD, SYSTEM AND APPARATUS FOR DIRECTLY DRIVING LCD GLASS

FIELD OF THE INVENTION

The present invention relates generally to liquid crystal displays (LCDs), and more particularly to a system, apparatus and method for directly driving LCD glass with a switched mode digital logic circuit.

BACKGROUND OF THE INVENTION TECHNOLOGY

Liquid crystal displays (LCDs) are commonly used in consumer electronics such as digital thermostats, alarm control panels, sprinkler system control panels, alarm clock radios, kitchen and laundry appliances, etc. LCDs act in effect as light valves, i.e., they allow transmission of light in one state, block the transmission of light in a second state, and some include several intermediate stages for partial transmission of light. The LCD comprises a thin layer of "liquid crystal material" deposited between two plates of glass, and is often referred to as "glass." Electrodes are attached to the inside (facing) sides of the plates of the glass. One electrode is referred to as common or backplane, and the other electrodes making up alpha-numeric and/or graphical images on the LCD are referred to as segments or pixels. Segments and pixels will be used herein interchangeably and will designate the LCD electrodes closest to the viewing surface of the LCD, e.g., between the backplane electrode(s) and the front of the LCD.

The LCD operates by applying a root mean square voltage ($V_{RMS}$) between the backplane electrode and the pixel electrode. When a $V_{RMS}$ level of zero volts is applied to the LCD, the LCD is substantially transparent. To turn a LCD pixel "on," which makes the pixel turn dark or opaque, a $V_{RMS}$ level greater than the LCD threshold voltage is applied to the LCD. Different LCD material have different characteristics but all have in common a minimum RMS voltage that produces 90% contrast, Von, and a maximum RMS voltage that produces 10% contrast, Voff. Contrast is maximized when the LCD pixel is at its darkest or most opaque.

Many LCDs are multiplexed, that is, they have multiple common lines (also called backplanes) for a given set of segment connections. The timing pattern of sequentially selecting all of the backplanes is called a multiplex frame. Since the commons must multiplex or time-share their LCD segment data on the segment lines, the instantaneous voltage across these segments must be increased. Most LCD driver applications use charge-pump circuits to boost the voltage across the LCD pixels; this technology along with resistor ladders, allow LCD glass to be driven by multiple voltage sources.

LCD drivers have a high voltage level, Voh, and a low voltage level, Vol. When an LCD has just one backplane, the RMS voltage between the backplane and the segment(s) would be equal to Voh−Vol of the drivers. This is true because all segment(s) of the LCD glass would be constantly driven all the time. But if there are multiple backplanes, all segments cannot be driven concurrently. In order to adhere to the RMS Von spec of the LCD, when a given backplane of a segment(s) must be driven, then a greater voltage must be applied thereto. This is the reason why charge-pumps are traditionally used when driving LCD glass.

Notice that RMS voltages are specified on LCDs. This is an important requirement; LCD's require zero DC offset.

Even a small DC offset (usually greater than 50 mV) across any LCD material can damage that material. In order to keep the LCD glass 'unpolarized', all of the asserted signals applied to an LCD must be reversed continually. The polarities between the backplane(s) and segments are typically changed after every multiplex frame. So, each positive frame is followed by a negative one, etc.

Another technique used by LCD designers is multiple voltage levels, also known as bias. These bias voltages allow the asserted segments in a multiplexed LCD to be driven while the deasserted ones remain at a voltage too low to affect them. A ½ bias drive would consist of two voltage levels above ground; or, Voh, and a mid-level voltage. A ⅓ bias drive would have a fourth voltage level (e.g., two voltages between Voh and Vol). And, a ¼ bias drive would have three mid-voltage levels equally spaced between Voh and Vol. And so on for other bias ratios. Charge pumps are often also used to generate a greater supply voltage which, through the use of resistor ladder networks, create the desired middle voltages.

The asserted common line is at either Voh or Vol (depending if this is a positive or negative multiplex frame). The segment lines are brought to either Voh or Vol so as to produce the segment pattern desired. The non-asserted common lines must also have a certain voltage value for proper operation of the LCD. If the voltage driven on them was Voh or Vol, some other (e.g., non-selected) pixels would be affected since the segment lines are being driven. The unused commons cannot be left floating because a DC bias can result on the deasserted ones (e.g., one leg of these capacitors are tied to the pixel lines being driven and the other legs are tied to a floating common). The solution is to bring the deasserted commons to a mid-voltage. This voltage must be such that the voltage across a deasserted segment is LOWER than Voff and the voltage across an asserted segment is HIGHER than Von. When there are multiple backplanes present, sometimes it is easier to implement this with higher order bias ratios (⅓, ¼, ⅕, ⅙ or more).

More detailed descriptions of LCD operation and technologies are disclosed in Application notes AN563 and AN658 by Microchip Technologies Inc., 2355 West Chandler Blvd., Chandler, Ariz. 85224-6199. These application notes are incorporated herein by reference for all purposes.

Because of consumer product cost constraints, ease of manufacture, miniaturization, improved reliability, etc., it is desirable for a digital circuit (e.g., microcontroller, microprocessor, programmable logic array (PLA), application specific integrated circuit (ASIC) and the like) to directly drive LCD glass. An added benefit would be the ability to directly drive LCD glass having a plurality of backplanes and be able to also control contrast of the LCD without additional hardware components or manual adjustments.

What is needed is a system, method and apparatus for directly driving LCD glass with digital logic while retaining the capabilities of using multiplexed multiple backplanes with associated pixels and, in addition, being able to control LCD segment or pixel contrast.

SUMMARY OF THE INVENTION

The invention overcomes the above-identified problems as well as other shortcomings and deficiencies of existing technologies by providing hardware and software methods, and an apparatus for directly driving liquid crystal display (LCD) glass with a digital logic circuit (e.g., microcontroller, microprocessor, programmable logic array (PLA), application specific integrated circuit (ASIC) and the like). Software programs, firmware in EEPROM, mask ROM or a hardwired state machine, etc., may be used for control of the digital logic circuit. An exemplary software program for a microcontroller is attached hereto as "Appendix A" and is incorporated herein by reference for all purposes.

Advances in LCD technology allow the design engineer to specify lower voltage chemistries in their LCD displays and thus avoid using costly charge-pump circuits and power consumptive resistor ladders in their designs. This can be done via switch-mode techniques that need only a single supply voltage. The digital logic circuit has a plurality of digital outputs coupled to the backplane(s) and pixels of the LCD glass and functions as a "switched mode" LCD driver having the following features: 1) Substantially no DC bias of the LCD glass by continually reversing voltage polarity across the LCD material, 2) maintaining minimum refresh rate so as to avoid flicker, 3) the resultant RMS voltage across a deasserted pixel is less than Voff, and 4) the resultant RMS voltage across an asserted pixel is greater than Von.

Low power and voltage, e.g., 3.3 volts or lower, product applications using a microcontroller and an LCD will especially benefit from the present invention. For example, battery operated devices do not require power consuming charge pumps or resistor networks when using the embodiments of the present invention.

LCD contrast may be controlled by adjusting the time interval of the phases wherein all segments have no RMS voltage potential The longer the LCD segments remain at a zero potential, the lower the bias on all of the segments, hence contrast is lowered.

According to the present invention, different segments may have different contrast or shading. This is accomplished as follows, for a high contrast segment more phases are at Von for that segment. For a lower contrast segment, less phases are at Von.

The present invention is directed to an apparatus for driving a liquid crystal display (LCD), said apparatus comprises a liquid crystal display (LCD) having N backplanes and a plurality of segments; and a microcontroller having a plurality of digital outputs, wherein the N backplanes and the plurality of segments of the LCD are coupled directly to the plurality of digital outputs of the microcontroller. Wherein N is a positive integer number. The microcontroller and LCD may be adapted to be powered from a battery power supply. The LCD driving voltages are pulses from the microcontroller having voltage amplitudes substantially the same as a supply voltage of the microcontroller. The microcontroller drives the LCD according to an LCD driver program. The LCD driver program controls the microcontroller to produce a series of pulses from the plurality digital outputs coupled to the N backplanes and the plurality of segments of the LCD so as to control the LCD. The LCD driver program controls amplitude and duration of the series of pulses from the microcontroller so that there is a continually reversing voltage polarity across the LCD material. The LCD driver program controls amplitude and duration of the series of pulses from the microcontroller so that there is substantially no noticeable flicker of the LCD. The LCD driver program controls amplitudes and duration of the series of pulses from the microcontroller so that a resultant RMS voltage across an asserted one of the plurality of segments is greater than Von. The LCD driver program controls amplitude and duration of the series of pulses from the microcontroller so that a resultant RMS voltage across a deasserted one of the plurality of segments is less than Voff. The LCD driver program varies some of the duration's of the series of pulses from the microcontroller so as to control the segment contrast of the LCD. The LCD driver program varies some of the amplitudes of the series of pulses from the microcontroller so as to control contrast between the plurality of segments of the LCD. A temperature sensor may be coupled to the microcontroller, wherein the temperature sensor supplies ambient temperature information to the microcontroller so that the LCD operating parameters may be adjusted for changes in the ambient temperature.

The present invention is also directed to a system using a microcontroller and a liquid crystal display (LCD), said system comprising: a liquid crystal display (LCD) having N backplanes and a plurality of segments; a microcontroller having a plurality of digital outputs, wherein the N backplanes and the plurality of segments of said LCD are coupled directly to some of the plurality of digital outputs of said microcontroller; and a control program for controlling said microcontroller, wherein said microcontroller performs a function and controls said LCD. The LCD may display parameters and information relating to the function.

The function performed by the microcontroller may include, but is not limited to, control of temperature (thermostat), humidity, sprinkler, alarm and security system, alarm clock, timer, clothes dryer, washing machine, toaster, microwave, oven, cooktop, clothes iron, water heater, tankless water heater, solar heating, swimming pool, jacuzzi, answering machine, pager, telephone, intercom, caller identification, electronic address book, treadmill, stationary bicycle, exercise machine, torque wrench, depth gauge, scale, speedometer, automobile tire condition status, anti-skid and anti-lock brakes, fuel gauge, engine monitoring, operation of luminaries (lights) in a building, power load management, video cassette player, DVD player, uninterruptable power supply (UPS), dictaphone, tape recorder, MP3 music player, video game toy, calculator, personal digital organizer, etc.

The present invention is further directed to a method of operation for driving a liquid crystal display (LCD) having a backplane and a plurality of segments, said method comprising the steps of:

- applying a high level to a backplane, a low level to asserted ones of a plurality of segments, and the high level to deasserted ones of the plurality of segments for a first time period;
- applying the high level to the backplane, the low level to the asserted ones of the plurality of segments, and the high level to the deasserted ones of the plurality of segments for the first time period;
- applying the high level to the backplane, the low level to the asserted ones of the plurality of segments, and the low level to the deasserted ones of the plurality of segments for the first time period;
- applying the low level to the backplane, the low level to the asserted ones of the plurality of segments, and the low level to the deasserted ones of the plurality of segments for a second time period;
- applying the low level to the backplane, the high level to the asserted ones of the plurality of segments, and the low level to the deasserted ones of the plurality of segments for the first time period;
- applying the low level to the backplane, the high level to the asserted ones of the plurality of segments, and the low level to the deasserted ones of the plurality of segments for the first time period;

applying the low level to the backplane, the high level to the asserted ones of the plurality of segments, and the high level to the deasserted ones of the plurality of segments for the first time period; and applying the high level to the backplane, the high level to the asserted ones of the plurality of segments, and the high level to the deasserted ones of the plurality of segments for the second time period.

The present invention is also directed to a method of operation for driving a liquid crystal display (LCD) having N backplanes and a plurality of segments, said method comprising the steps of:

a) applying a high level to an asserted backplane i of N backplanes, the high level to deasserted backplanes of the N backplanes, the low level to asserted ones of a plurality of segments, and the high level to deasserted ones of the plurality of segments for a first time period;

b) applying the high level to the asserted backplane i of the N backplanes, the low level to the deasserted backplanes of the N backplanes, the low level to the asserted ones of the plurality of segments, and the high level to the deasserted ones of the plurality of segments for the first time period;

c) applying the high level to the asserted backplane i of the N backplanes, the low level to the deasserted backplanes of the N backplanes, the low level to the asserted ones of the plurality of segments, and the low level to the deasserted ones of the plurality of segments for the first time period;

d) applying the low level to the asserted backplane i of the N backplanes, the low level to the deasserted backplanes of the N backplanes, the low level to the asserted ones of the plurality of segments, and the low level to the deasserted ones of the plurality of segments for a second time period;

e) applying the low level to the asserted backplane i of the N backplanes, the low level to the deasserted backplanes of the N backplanes, the high level to the asserted ones of the plurality of segments, and the low level to the deasserted ones of the plurality of segments for the first time period;

f) applying the low level to the asserted backplane i of the N backplanes, the high level to the deasserted backplanes of the N backplanes, the high level to the asserted ones of the plurality of segments, and the low level to the deasserted ones of the plurality of segments for the first time period;

g) applying the low level to the asserted backplane i of the N backplanes, the high level to the deasserted backplanes of the N backplanes, the high level to the asserted ones of the plurality of segments, and the high level to the deasserted ones of the plurality of segments for the first time period;

h) applying the high level to the asserted backplane i of the N backplanes, the high level to the deasserted backplanes of the N backplanes, the high level to the asserted ones of the plurality of segments, and the high level to the deasserted ones of the plurality of LCD segments for the second time period; and i) incrementing i by 1 then repeating steps a) through h) until i=N.

The present invention is also directed to a method of operation for driving a liquid crystal display (LCD) having N backplanes and a plurality of segments, said method comprising the steps of:

a) applying a low level to an asserted backplane i of N backplanes, the low level to deasserted backplanes of the N backplanes, the low level to asserted ones of a plurality of segments, and a high level to deasserted ones of the plurality of segments for a first time period;

b) applying the low level to the asserted backplane i of the N backplanes, the high level to the deasserted backplanes of the N backplanes, the low level to the asserted ones of the plurality of segments, and the high level to the deasserted ones of the plurality of segments for the first time period;

c) applying the low level to the asserted backplane i of the N backplanes, the high level to the deasserted backplanes of the N backplanes, the low level to the asserted ones of the plurality of segments, and the low level to the deasserted ones of the plurality of segments for the first time period;

d) applying the low level to the asserted backplane i of the N backplanes, the low level to the deasserted backplanes of the N backplanes, the low level to the asserted ones of the plurality of segments, and the low level to the deasserted ones of the plurality of segments for a second time period;

e) applying the high level to the asserted backplane i of the N backplanes, the high level to the deasserted backplanes of the N backplanes, the high level to the asserted ones of the plurality of segments, and the low level to the deasserted ones of the plurality of segments for the first time period;

f) applying the high level to the asserted backplane i of the N backplanes, the low level to the deasserted backplanes of the N backplanes, the high level to the asserted ones of the plurality of segments, and the low level to the deasserted ones of the plurality of segments for the first time period;

g) applying the high level to the asserted backplane i of the N backplanes, the low level to the deasserted backplanes of the N backplanes, the high level to the asserted ones of the plurality of segments, and the high level to the deasserted ones of the plurality of segments for the first time period;

h) applying the high level to the asserted backplane i of the N backplanes, the high level to the deasserted backplanes of the N backplanes, the high level to the asserted ones of the plurality of segments, and the high level to the deasserted ones of the plurality of LCD segments for the second time period; and i) incrementing i by 1 then repeating steps a) through h) until i=N.

The present invention is also directed to a method of operation for driving a liquid crystal display (LCD) having N backplanes and a plurality of segments, said method comprising the steps of:

a) applying a high level to an asserted backplane i of N backplanes, the high level to deasserted backplanes of the N backplanes, a low level to asserted ones of a plurality of segments, and the high level to deasserted ones of the plurality of segments for a first time period;

b) applying the high level to the asserted backplane i of the N backplanes, the low level to the deasserted backplanes of the N backplanes, the low level to the asserted ones of the plurality of segments, and the high level to the deasserted ones of the plurality of segments for the first time period;

c) applying the low level to the asserted backplane i of the N backplanes, the low level to the deasserted backplanes of the N backplanes, the low level to the asserted ones of the plurality of segments, and the low level to the deasserted ones of the plurality of segments for a second time period;

d) applying the low level to the asserted backplane i of the N backplanes, the low level to the deasserted backplanes of the N backplanes, the high level to the asserted ones of the plurality of segments, and the low level to the deasserted ones of the plurality of segments for the first time period;

e) applying the low level to the asserted backplane i of the N backplanes, the high level to the deasserted backplanes of the N backplanes, the high level to the asserted ones of the plurality of segments, and the low level to the deasserted ones of the plurality of segments for the first time period;

f) applying the high level to the asserted backplane i of the N backplanes, the high level to the deasserted backplanes of the N backplanes, the high level to the asserted ones of the plurality of segments, and the high level to the deasserted ones of the plurality of segments for the second time period; and g) incrementing i by 1 then repeating steps a) through f) until i=N.

The present invention is also directed to a method of operation for driving a liquid crystal display (LCD) having a backplane and a plurality of segments, said method comprising the steps of:

a) applying a low level to an asserted backplane i of N backplanes, a high level to deasserted backplanes of the N backplanes, the low level to asserted ones of a plurality of segments, and the high level to deasserted ones of the plurality of segments for a first time period;

b) applying the low level to the asserted backplane i of the N backplanes, the low level to the deasserted backplanes of the N backplanes, the low level to the asserted ones of the plurality of segments, and the high level to the deasserted ones of the plurality of segments for the first time period;

c) applying the low level to the asserted backplane i of the N backplanes, the low level to the deasserted backplanes of the N backplanes, the low level to the asserted ones of the plurality of segments, and the low level to the deasserted ones of the plurality of segments for a second time period;

d) applying the high level to the asserted backplane i of the N backplanes, the low level to the deasserted backplanes of the N backplanes, the high level to the asserted ones of the plurality of segments, and the low level to the deasserted ones of the plurality of segments for the first time period;

e) applying the high level to the asserted backplane i of the N backplanes, the high level to the deasserted backplanes of the N backplanes, the high level to the asserted ones of the plurality of segments, and the low level to the deasserted ones of the plurality of segments for the first time period;

f) applying the high level to the asserted backplane i of the N backplanes, the high level to the deasserted backplanes of the N backplanes, the high level to the asserted ones of the plurality of segments, and the high level to the deasserted ones of the plurality of segments for the second time period; and g) incrementing i by 1 then repeating steps a) through f) until i=N.

A technical advantage of the present invention is low cost and reduced number of parts.

Another technical advantage is operation at low operating voltage levels.

Another technical advantage is no external or additional parts are required to directly drive the LCD.

Still another technical advantage is correction of the LCD bias voltages based on temperature.

A feature of the present invention is directly driving LCD glass without resistor networks or charge pumps.

Another feature is software control of contrast and brightness of LCD segments.

Another feature is operation at low voltage and/or system voltage.

Another feature is adjustment of LCD bias voltages based on temperature.

Features and advantages of the invention will be apparent from the following description of the embodiments, given for the purpose of disclosure and taken in conjunction with the accompanying drawings.

BRIEF DESCRIPTION OF THE DRAWINGS

A more complete understanding of the present disclosure and advantages thereof may be acquired by referring to the following description taken in conjunction with the accompanying drawing, wherein.

Figure 1:
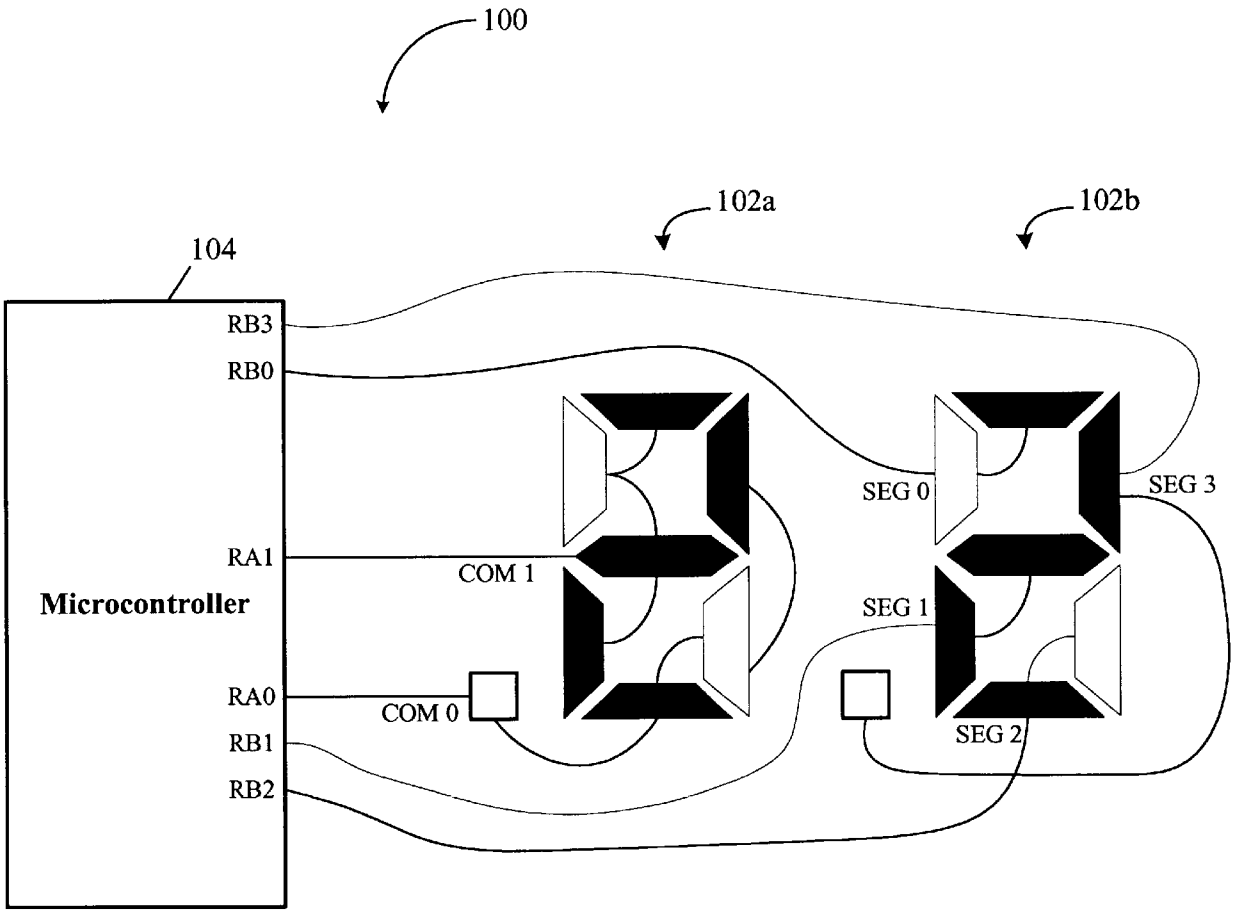
FIG. 1 illustrates a schematic block diagram of an exemplary embodiment of a directly driven LCD.

While the present invention is susceptible to various modifications and alternative forms, specific exemplary embodiments thereof have been shown by way of example in the drawing and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

The present invention is directed to a method, system and apparatus for directly driving liquid crystal display (LCD) glass with a digital logic circuit (e.g., microcontroller, microprocessor, programmable logic array (PLA), application specific integrated circuit (ASIC) and the like) running in a switched mode of operation. The invention comprises a digital circuit having a plurality of digital outputs coupled to backplane(s) and pixels of a LCD glass in combination with a software program so as to function as a "switched mode" LCD driver. Battery powered devices comprising a microcontroller directly coupled to an LCD have improved battery life and reduced costs because of simplification of the LCD driver circuits, according to the present invention.

Referring now to the drawing, the details of exemplary embodiments of the present invention are schematically illustrated. Like elements in the drawing will be represented by like numbers, and similar elements will be represented by like numbers with a different lower case letter suffix.

Referring to FIG. 1, depicted is a schematic block diagram of an LCD system represented by the numeral 100. The LCD system 100 comprises an integrated circuit microcontroller 104 adapted for driving an LCD glass 102 without requiring intermediate circuitry between the microcontroller 104 and the LCD glass 102 (represented herein by backplane (s) 102*a* and segments 102*b*). The microcontroller 104 in combination with a software program is configured to function as a switched mode—adjustable duty cycle driver. The microcontroller 104 is coupled to backplanes 102*a* and segments 102*b* of the LCD glass 102. Digital outputs RA0 and RA1 of the microcontroller 104 are coupled to COM 0 and COM 1, respectively, of the backplanes 102*a*. Digital outputs RB0, RB1, RB2 and RB3 of the microcontroller 104 are coupled to SEG 0, SEG 1, SEG 2 and SEG 3, respectively, of the segments 102*b*. The microcontroller 104 is programmed to drive the LCD glass so that there is substantially no DC bias because the voltage polarities between electrodes (backplane(s) 102*a* and segments 102*b*) are being continually reversed but remain equal in magnitude, a minimum refresh rate is maintained to avoid flicker of the LCD, the resultant RMS voltage across a deasserted segment is less than Voff, and the resultant RMS voltage across an asserted segment 102*a* is greater than Von.

The discrete equation for RMS voltage is:

$$V_{RMS} = \sqrt{\frac{1}{N}\sum_{n=1}^{N} v_n^2} \qquad \text{Equation 1}$$

Figure 2:
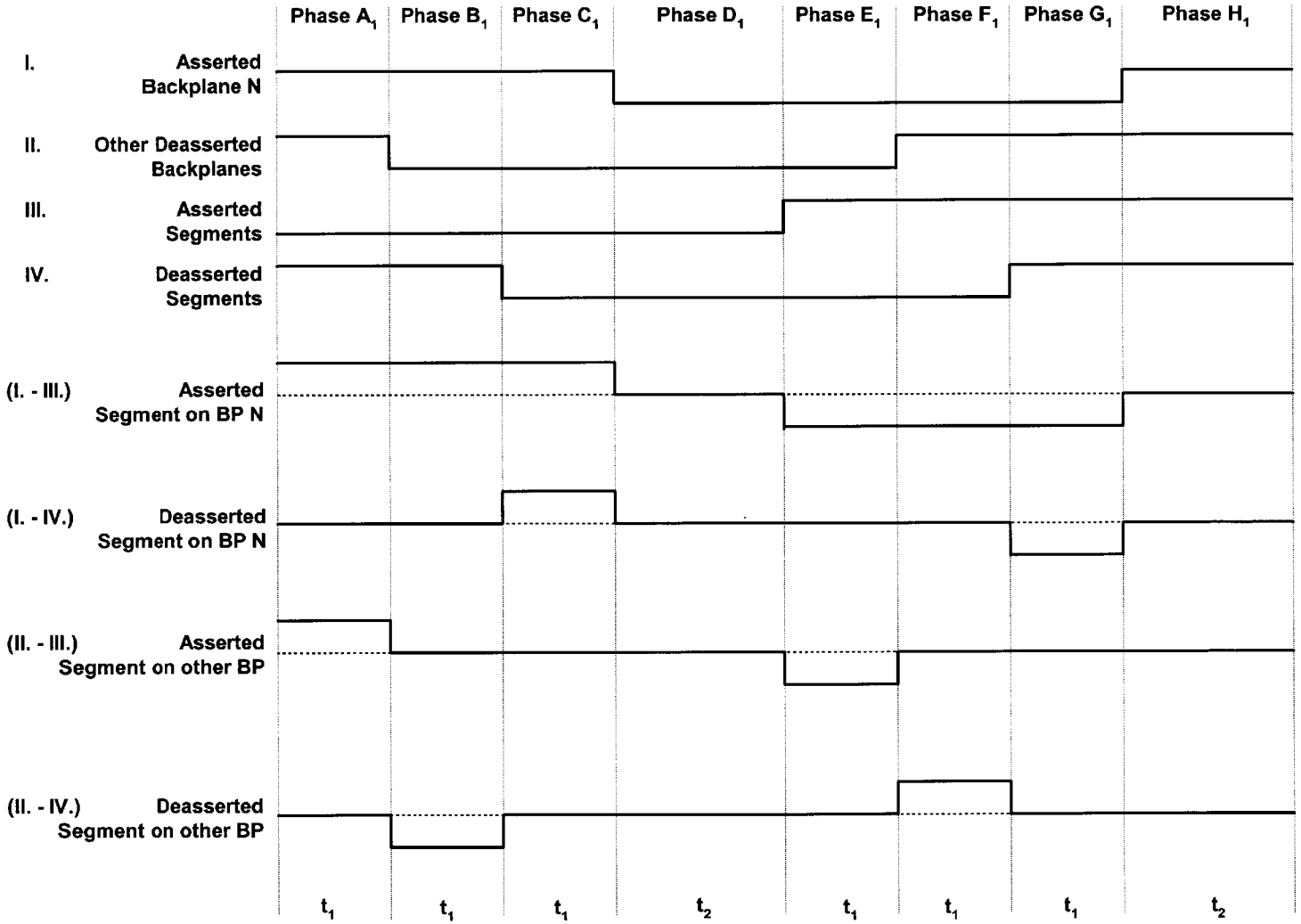
FIG. 2 illustrates an exemplary schematic timing diagram of an embodiment of the invention.

Referring now to FIG. 2, depicted is an exemplary schematic timing diagram of a 1:3 Voff biased switched mode embodiment of the present invention. Eight phases from the microcontroller 104, represented by Phase $A_1$ through Phase $H_1$, sequentially drive the LCD glass 102 for each multiplex frame. The first four phases are the "Positive Multiplex Subframe" and the last four phases are the "Negative Multiplex Subframe."

These sequence of eight phases are repeated for each backplane 102*a* on the LCD glass 102. The following steps are performed (and depicted in FIG. 2) in eight phases ($A_1$–$H_1$) for Backplane N and then repeated for each subsequently asserted backplane. Note that phase $D_1$ and phase $H_1$ have all segments 102*b* driven with zero potential and that the time duration of these two phases is different than all the others. These may be seen in the following phase state descriptions:

Phase $A_1$

Backplane N is ASSERTED & High
All other backplanes are DEASSERTED & High
Asserted segments are Low
Deasserted segments are High
Timeout period=$t_1$ Phase $B_1$ Backplane N is ASSERTED & High
All other backplanes are DEASSERTED & Low
Asserted segments are Low
Deasserted segments are High
Timeout period=$t_1$ Phase $C_1$ Backplane N is ASSERTED & High
All other backplanes are DEASSERTED & Low
Asserted segments are Low
Deasserted segments are Low
Timeout period=$t_1$ Phase $D_1$ Backplane N is ASSERTED & Low
All other backplanes are DEASSERTED & Low
Asserted segments are Low
Deasserted segments are Low
Timeout period=$t_2$ Phase $E_1$ Backplane N is ASSERTED & Low
All other backplanes are DEASSERTED & Low
Asserted segments are High
Deasserted segments are Low
Timeout period=$t_1$ Phase $F_1$ Backplane N is ASSERTED & Low
All other backplanes are DEASSERTED & High
Asserted segments are High
Deasserted segments are Low
Timeout period=$t_1$ Phase $G_1$ Backplane N is ASSERTED & Low
All other backplanes are DEASSERTED & High
Asserted segments are High
Deasserted segments are High
Timeout period=$t_1$ Phase $H_1$ Backplane N is ASSERTED & High
All other backplanes are DEASSERTED & High
Asserted segments are High
Deasserted segments are High
Timeout period=$t_2$ These eight phases translate to the states of a 'state machine' programmed on the microcontroller. That is, there are eight states per backplane or 8N total states in the machine). The order of the aforementioned phase states is exemplary and it is contemplated and within the scope of the present invention that these states may be executed in any order so long as the resulting RMS voltages are the same, any phase state sequence is appropriate.

The waveforms depicted in FIG. 2 show these multiplex frame phases graphically along with the resulting voltage waveforms on four classes of pixels. These four classes of pixels are herein defined:

1. Asserted pixels wired to the current asserted backplane signal
2. Asserted pixels wired to a deasserted backplane signal
3. Deasserted pixels wired to the current asserted backplane signal
4. Deasserted pixels wired to a deasserted backplane signal These four classes of pixels may be further defined as subsets of the set of all pixels on the LCD. Furthermore, the union of these four subsets equals the set of all LCD pixels. So, at each point in time in the waveforms of FIG. 2, the instantaneous voltage on every pixel in the LCD can be determined. Furthermore, all of these instantaneous voltages on a given pixel can be used to calculate the resulting RMS voltage of that pixel.

LCD contrast may be controlled by adjusting the time interval of the phases wherein all segments have no RMS voltage potential The longer the LCD segments remain at a zero potential, the lower the bias on all of the segments, hence contrast is lowered.

The voltage potential and polarity are dependent upon the relationship between the voltage levels applied to the backplanes and segments and the time durations thereof. As depicted in FIG. 2, the asserted segment(s) on Backplane N (I.–III.) is at a positive logic high for three phase intervals (Phases $A_1$, $B_1$ and $C_1$) and is at a negative logic high for three phase intervals (Phases $E_1$, $F_1$ and $G_1$). During Phases D and H the voltage potential is at a logic low (approximately zero volts). Therefore, the RMS waveform across the asserted segments and the Backplane N is RMS symmetrical and therefore leaves no DC component on the segments. Having a logic high on the asserted segments for three time periods, $t_1$, positive and three time periods, $t_1$, negative, assures that the active segment is at or above Von.

The deasserted segment(s) on the N Backplane (I.–IV.) is at a positive logic high for only one phase interval (Phase $C_1$) and is at a negative logic high for one phase interval (Phase $G_1$). During Phases $A_1$, $B_1$, $D_1$, $E_1$, $F_1$ and $H_1$ the voltage potential is at a logic low (approximately zero volts). Therefore, the RMS waveform across the deasserted segment(s) and the N Backplane is RMS symmetrical and therefore leaves no DC component on these segments. Since the logic high is only for one time period, $t_1$, positive and one time period, $t_1$, negative, the deasserted segment(s) of the N Backplane never go above Voff.

In a similar fashion to the deasserted segment(s) described above, the asserted segment(s) on the other backplane(s) (II.–III.) are at a logic high for only one time interval at a positive polarity (Phase $A_1$) and one time interval at a negative polarity (Phase $E_1$). Likewise, the deasserted segment(s) on the other backplane(s) (II.–IV.) are at a logic high for only one time interval at a positive polarity (Phase $E_1$) and one time interval at a negative polarity (Phase $B_1$). During the remaining time intervals, the voltage is at a logic zero. All RMS waveforms are symmetrical and thus there is substantially no DC component buildup on the segments.

As depicted in the waveforms of FIG. 2, the voltages on the backplane and segment lines are either Vol or Voh. Furthermore, since the LCD pixels are typically modeled as capacitors and so, require almost no current drive once charged, a CMOS device driving a pixel effectively generates 0 volts for Vol and $V_{DD}$ volts for Voh. This range of voltage, Voh−Vol is defined herein as Vr.

The potentials across the pixels can be Vr, 0, or −Vr. The first requirement for directly driving LCD's, that is, no DC bias on the pixels is met and can be verified visually by the waveforms of FIG. 2. For every positive pulse on a pixel there is a corresponding negative one. Therefore, the voltage across all pixel classes averages to zero. Note that the asserted pixels connected to the currently asserted backplane drives three times as long as the other pixel classes. This added amount of time is what makes the visual difference between an opaque pixel and a transparent one.

Where, the voltage v is measured over N intervals. Defining $V_{Lo}$ as the RMS voltage of a deasserted pixel, the following Equation 2 may be derived:

$$V_{Lo} = \sqrt{\left(\frac{1}{T}\right)\cdot[2Nt_1]\cdot V_r^2} \qquad \text{Equation 2}$$

Where T is the total time interval of the multiplex frame, N is the number of backplanes, and Vr is +/− (Voh−Vol). Time interval $t_2$ can be represented as a function of ti, via the use of a constant, C, so that:

$$t_2 = C\cdot t_1$$

From this T can be found as a function of $t_1$:

$$T=(6t_1+2t_2)\cdot N=2N(3t_1+Ct_1)=2Nt_1(3+C) \qquad \text{Equation 3}$$

Substituting this into Equation 2 yields:

$$V_{Lo} = \sqrt{\frac{2\,Nt_1V_r^2}{2\,Nt_1(3+C)}} = \sqrt{\frac{1}{3+C}}\cdot V_r \qquad \text{Equation 4}$$

Similarly, $V_{Hi}$ can be calculated:

$$V_{Hi} = \sqrt{\frac{1}{T}[6t_1V_r^2 + 2(N-1)t_1V_r^2]}$$

Substituting the relation for T from Equation 3 and reducing yields:

$$V_{Hi} = \sqrt{\frac{6t_1 + 2(N-1)t_1}{2\,Nt_1(3+C)}}\cdot V_r = \sqrt{\frac{6+2N-2}{2N(3+C)}}\cdot V_r$$

Simplifying:

$$V_{Hi} = \sqrt{\frac{2+N}{N(3+C)}}\cdot V_r \qquad \text{Equation 5}$$

Equations 4 and 5 for $V_{Lo}$ and $V_{Hi}$, respectively, may be used to calculate the lower and upper possible voltages of any segment on the LCD glass according to the present invention.

Note that all the phases have the same time interval, $t_1$, except for phases $D_1$ and $H_1$; the time interval for these phases is $t_2$. Also, note that during phases $D_1$ and $H_1$, all of the backplane and segment lines are at the same voltage. This means that the potential across all segments is zero volts during these time intervals. Therefore, $V_{Lo}$ and $V_{Hi}$ can both be adjusted by varying the duration of time $t_2$. Using Equations 4 and 5, 'operating points' may be determine for the LCD drive by choosing an effective value for the constant C. Also the value of C determines the voltage setpoint, or bias, of Voff.

Setting $V_{Lo}$ equal to the LCD specification, Voff (the 10% operating point), in Equation 4, dividing both sides by $V_r$, and squaring both sides:

$$\frac{V_{off}^2}{V_r^2} = \frac{1}{3+C}$$

Rearranging, $$3 + C = \frac{V_r^2}{V_{off}^2} \quad \text{Equation 6}$$

Solving for C, yields:

$$C = \frac{V_r^2}{V_{off}^2} - 3 = \frac{V_r^2 - 3V_{off}^2}{V_{off}^2} \quad \text{Equation 7}$$

One of the requirements stated herein for driving an LCD is that a minimum refresh rate be maintained on the LCD to avoid flicker. Since C in Equation 7 determines the relationship between $t_1$ and $t_2$, and LCD manufacturers specify an operating frequency for their LCD glass, $t_1$ and $t_2$ may be calculated:

$$t_1 = \frac{1}{[2N(\text{freq})(3 + C)]} \quad \text{Equation 8}$$

And as defined before, $t_2$ is:

$$t_2 = Ct_1 \quad \text{Equation 9}$$

Therefore, $t_1$ and $t_2$ may be chosen so that the resulting $V_{Lo}$ RMS voltage across any pixel is being biased to the specification, Voff. Preferably all of the pixels on the LCD are being biased to a voltage that just barely has them turned on (remember, Voff is the 10% contrast point). Any added bias to any pixel will make it darker and given enough, ($V_{Hi}$) make it visible (opaque). Thus, the reference of this exemplary embodiment to 1:3 Voff Biased.

However, there is a limit since an endless number of backplanes cannot be multiplex at a given $V_{DD}$, or for that matter, support $V_{DD}$ levels below a certain point. These limitations may be calculated. From Equation 6, the minimum $V_{DD}$ level possible can be determined. The time interval $t_2$ will be shorter and shorter for lower values of $V_r$ (which is effectively equal to $V_{DD}$ since there is virtually no current flowing into the LCD). At some value of $V_{DD}$, the time interval $t_2$ may be substantially zero, so setting C equal to zero and defining $V_r$ equal to $V_{DD\ min}$ yields:

$$V_{DD\ min} = \sqrt{3} \cdot V_{off} \quad \text{Equation 10}$$

Equation 10 indicates that the present invention can generate bias voltages high enough to be able to turn on a segment as long as the supply voltage is above $V_{DD\ min}$. Calculation of how high a bias may be given to an asserted pixel is a function of the number of backplanes that need to be supported. This can be determined by using Equation 5 for calculating $V_{Hi}$. By setting $V_{Hi}$ equal to Von, dividing both sides by $V_r$, squaring both sides and substituting (3+C) from Equation 6, yields:

$$\frac{V_{on}^2}{V_r^2} = \frac{2 + N}{N(3 + C)} = \frac{(2 + N)V_{off}^2}{NV_r^2}$$

Multiplying both sides by $(V_r)^2$ and dividing both sides by $(V_{off})^2$ gives:

$$\frac{V_{on}^2}{V_{off}^2} = \frac{2 + N}{N} = \frac{2}{N} + 1$$

Or, after solving for N and setting N equal to Nmax:

$$N_{\max} = \frac{2V_{off}^2}{V_{on}^2 - V_{off}^2} \quad \text{Equation 11}$$

Note that Equation 11 is only a function of the characteristics of the LCD, there is no $V_r$ or $V_{DD}$ term in it. Furthermore, because of this restriction, not all LCDs may support a high number of backplanes. However, there are LCD manufacturers whose fluid chemistries can support a large number of backplanes according to the present invention. For example, referring to Table 1:

TABLE 1

| Company | Chemistry Description | | | Nmax | $V_{DD\ min}$ |
|---|---|---|---|---|---|
| LXD Inc. | Fluid Type: #18 | 2.75 | 3.00 | 10 | 4.76 |
| LXD Inc. | Fluid Type: #M2 | 2.75 | 3.00 | 10 | 4.76 |

The two fluids listed in Table 1 by LXD Inc., may support up to ten backplanes at 4.76 volts. Since the backplane and segment signals are generated by general purpose I/O pins, any digital logic, e.g., microcontroller or programmable logic device may be used to drive up to 10 backplanes of LCD glass at $V_{DD}$ of 5 volts.

This embodiment of the invention is biased to the parameter Voff. What is meant by the term 'Voff Biased' is this: Regardless of the supply voltage or the number of backplanes to be multiplexed, all pixels will be able to meet the Voff specification. The Von specification, however, will be affected by the number of backplanes to be supported and by the supply voltage.

Figure 3:
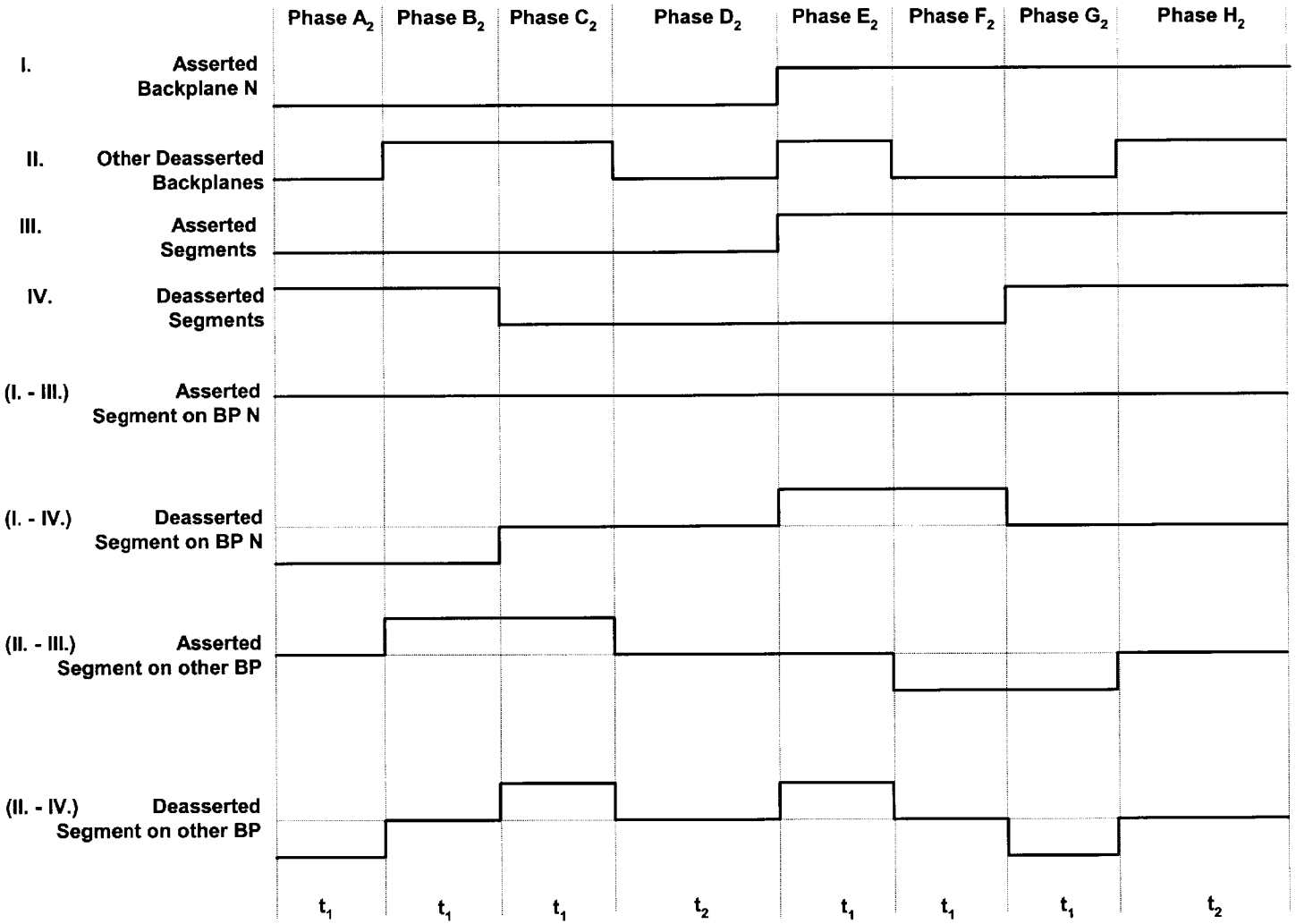
FIG. 3 illustrates an exemplary schematic timing diagram of another embodiment of the invention.

Referring now to FIG. 3, depicted is an exemplary schematic timing diagram of a 1:3 Von biased switched mode embodiment of the present invention. If the polarities of the backplane signals were inverted from those illustrated in FIG. 2 (1:3 Voff Biased) it is possible to drive the LCD glass biased to the parameter Von. In the 'Von Biased' embodiment regardless of the supply voltage or the number of backplanes to be multiplexed, all pixels will be able to meet the Von specification. The Voff specification, however, may be affected by the number of backplanes to be supported and by the supply voltage.

Eight phases from the microcontroller 104, represented by Phase $A_2$ through Phase $H_2$, sequentially drive the LCD glass 102 for each multiplex frame. These sequence of eight phases are repeated for each backplane 102*a* on the LCD glass 102. The following steps are performed (and depicted in FIG. 3) in eight phases ($A_2$–$H_2$) for Backplane N and then repeated for each subsequently asserted backplane. Note that phase $D_2$ and phase $H_2$ have all segments 102*b* driven with zero potential and that the time duration of these two phases is different than all the others.

Phase $A_2$

Backplane N is ASSERTED & Low
All other backplanes are DEASSERTED & Low
Asserted segments are Low
Deasserted segments are High
Timeout period=$t_1$ Phase $B_2$ Backplane N is ASSERTED & Low
All other backplanes are DEASSERTED & High Asserted segments are Low
Deasserted segments are High
Timeout period=$t_1$ Phase $C_2$ Backplane N is ASSERTED & Low
All other backplanes are DEASSERTED & High
Asserted segments are Low
Deasserted segments are Low
Timeout period=$t_1$ Phase $D_2$ Backplane N is ASSERTED & Low
All other backplanes are DEASSERTED & Low
Asserted segments are Low
Deasserted segments are Low
Timeout period=$t_2$ Phase $E_2$ Backplane N is ASSERTED & High
All other backplanes are DEASSERTED & High
Asserted segments are High
Deasserted segments are Low
Timeout period=$t_1$ Phase $F_2$ Backplane N is ASSERTED & High
All other backplanes are DEASSERTED & Low
Asserted segments are High
Deasserted segments are Low
Timeout period=$t_1$ Phase $G_2$ Backplane N is ASSERTED & High
All other backplanes are DEASSERTED & Low
Asserted segments are High
Deasserted segments are High
Timeout period=$t_1$ Phase $H_2$ Backplane N is ASSERTED & High
All other backplanes are DEASSERTED & High
Asserted segments are High
Deasserted segments are High
Timeout period=$t_2$ These eight phases translate to the states of a 'state machine' programmed on the microcontroller. That is, there are eight states per backplane or 8N total states in the machine). The order of the aforementioned phase states is exemplary and it is contemplated and within the scope of the present invention that these states may be executed in any order so long as the resulting RMS voltages are the same.

The voltage potential and polarity are dependent upon the relationship between the voltage levels applied to the backplanes and segments and the time durations thereof. As depicted in FIG. 3, the asserted segment(s) on Backplane N (I.–III.) is at a logic low for all phase intervals (Phases $A_2$ through $H_2$). Therefore, the RMS waveform across the asserted segments and the Backplane N is RMS symmetrical and therefore leaves no DC component on the segments.

The deasserted segments on the N Backplane (I.–IV.) are at a negative logic high for Phases $A_2$ and $B_2$, at a logic low for Phases $C_2$, $D_2$, $G_2$ and $H_2$ and at a positive logic high for Phases $E_2$ and $F_2$. Therefore, the RMS waveform across the deasserted segment(s) and the N Backplane is RMS symmetrical and therefore leaves no DC component on these segments. Since the logic high is only for two time intervals, $t_1$, positive and two time intervals, $t_1$, negative, the deasserted segment(s) of the N Backplane never go above Voff.

In a similar fashion to the deasserted segment(s) described above, the asserted segment(s) on the other backplane(s) (II.–III.) are at a logic high for only two time intervals at a positive polarity (Phases $B_2$ and $C_2$) and two time intervals at a negative polarity (Phases $F_2$ and $G_2$). Likewise, the deasserted segment(s) on the other backplane(s) (II.–IV.) are at a logic high for only two time intervals at a positive polarity (Phases $C_2$ and $E_2$) and two time intervals at a negative polarity (Phases $A_2$ and $G_2$). During the remaining time intervals, the voltage is at a logic zero. All RMS waveforms are symmetrical and thus there is substantially no DC component buildup on the segments.

$$V_{Lo} = \sqrt{\left(\frac{1}{T}\right)\cdot[2\cdot 2(N-1)t_1]\cdot V_r^2} \qquad \text{Equation 12}$$

Where T is determined to be the same as in Equation 3, and $t_2$ is defined in the same manner as Equation 10; this yields:

$$V_{Lo} = \sqrt{\frac{4(N-1)t_1 V_r^2}{2Nt_1(3+C)}} = \sqrt{\frac{N-1}{N}\cdot\frac{2}{3+C}}\cdot V_r \qquad \text{Equation 13}$$

And, for $V_{Hi}$, after using Equation 3 and 9 again yields:

$$V_{Hi} = \sqrt{\left(\frac{1}{T}\right)\cdot[2\cdot 2Nt_1]\cdot V_r^2} = \sqrt{\frac{2}{3+C}}\cdot V_r \qquad \text{Equation 14}$$

Biasing for Von requires setting $V_{Hi}$=Von in Equation 14 and solving for 3+C and C:

$$3+C = \frac{2V_r^2}{V_{on}^2} \qquad \text{Equation 15}$$

$$C = \frac{2V_r^2}{V_{on}^2} - 3 = \frac{2V_r^2 - 3V_{on}^2}{V_{on}^2} \qquad \text{Equation 16}$$

As disclosed hereinabove, the values for $t_1$ and $t_2$ can be calculated as a function of the LCD manufacturer's 'Refresh Rate' specification. Equation 8 and Equation 9, apply to this embodiment as well.

$V_{DD\ min}$ for this embodiment may be calculated. As the supply voltage is reduced, the constant C must be reduced to allow the LCD's maximum and minimum contrast to be maintained. At some point, C will equal zero, and the supply voltage will not be allowed to be reduced any further. So, setting C=0, in Equation 15, solving for Vr and then setting Vr equal to $V_{DD\ min}$ yields:

$$V_{DD\ \min} = \sqrt{\frac{3}{2}}\cdot V_{on} \qquad \text{Equation 17}$$

The number of backplanes may be derived from Equation 13. Substituting Equation 15 into Equation 13, eliminating Vr, solving for N and setting N=Nmax, yields:

$$N_{max} = \frac{V_{off}^2}{V_{on}^2 - V_{off}^2} \quad \text{Equation 18}$$

The ratio 1:3 described in the previous two embodiments, relate to the number of states that the asserted backplane line is driven to the number that the deasserted backplane lines are driven in any multiplex frame.

The following exemplary embodiments will disclose a six phase state switched-mode technique for driving LCD glass. Again, the term 'Voff Biased' is defined as: Regardless of the supply voltage or the number of backplanes to be multiplexed, all pixels will be able to meet the Voff specification. The Von specification, however, will be affected by the number of backplanes to be supported and by the supply voltage.

Figure 4:
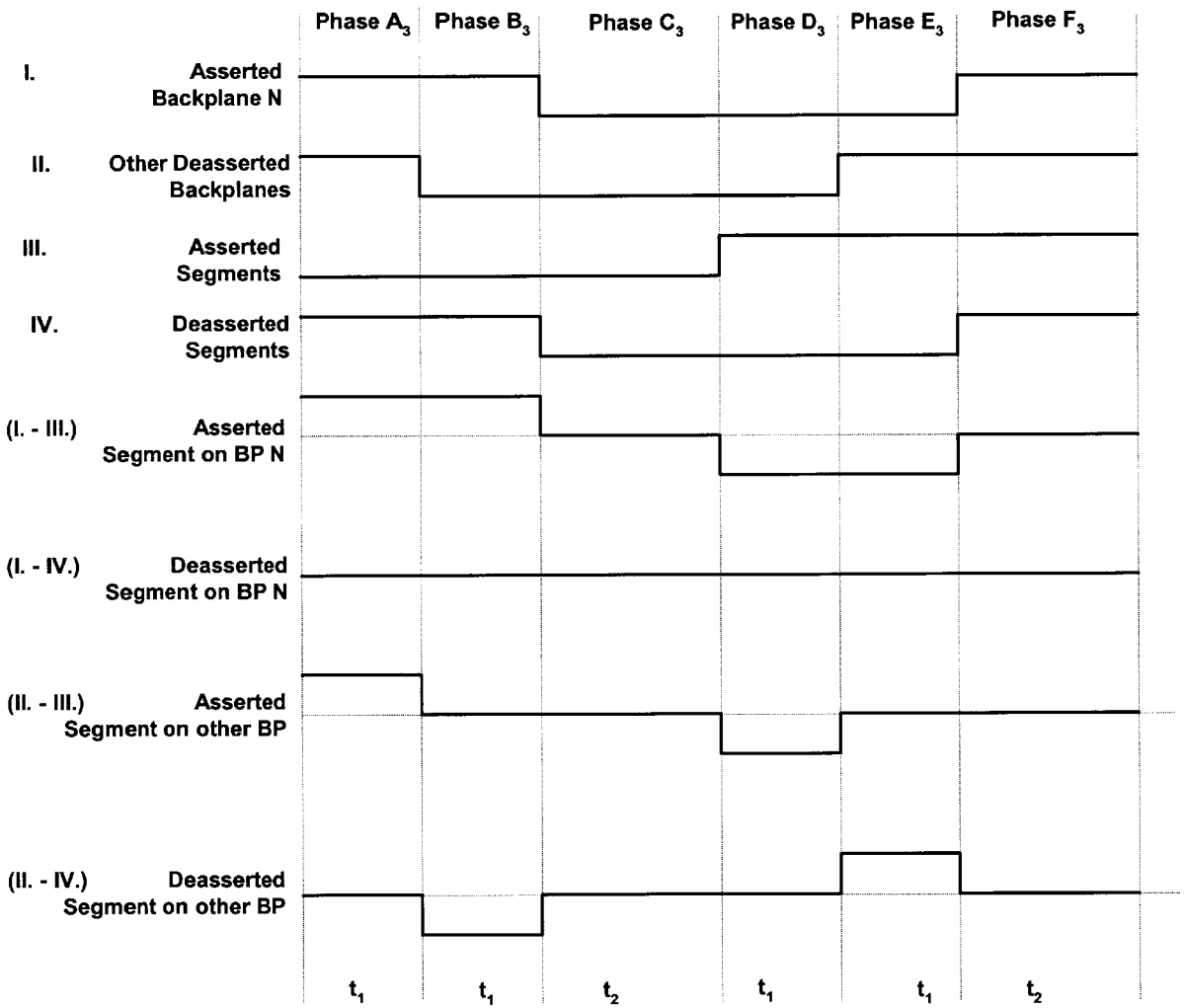
FIG. 4 illustrates an exemplary schematic timing diagram of still another embodiment of the invention.

In the following exemplary embodiments, the first three phase states comprise the positive multiplex Subframe and the last three, the negative multiplex Subframe. These can be seen more readily in FIGS. 4 and 5 and the detailed descriptions thereof in the state descriptions that herein follow:

Referring now to FIG. 4, depicted is an exemplary schematic timing diagram of a 1:2 Voff biased switched mode embodiment of the present invention. Six phases from the microcontroller 104, represented by Phase $A_3$ through Phase $F_3$, sequentially drive the LCD glass 102 for each multiplex frame. These sequence of six phases are repeated for each backplane 102*a* on the LCD glass 102. The following steps are performed (and depicted in FIG. 4) in six phases ($A_3$–$F_3$) for Backplane N and then repeated for each subsequently asserted backplane.

The currently asserted backplane is designated Backplane N. 1:2 indicates that the asserted backplane is driven in 2 states while the deasserted backplane is only driven in one. These may be seen in the following phase state descriptions:

Phase $A_3$

Backplane N is ASSERTED & High
All other backplanes are DEASSERTED & High
Asserted segments are Low
Deasserted segments are High
Timeout period=$t_1$ Phase $B_3$ Backplane N is ASSERTED & High
All other backplanes are DEASSERTED & Low
Asserted segments are Low
Deasserted segments are High
Timeout period=$t_1$ Phase $C_3$ Backplane N is ASSERTED & Low
All other backplanes are DEASSERTED & Low
Asserted segments are Low
Deasserted segments are Low
Timeout period=$t_2$ Phase $D_3$ Backplane N is ASSERTED & Low
All other backplanes are DEASSERTED & Low
Asserted segments are High
Deasserted segments are Low
Timeout period=$t_1$ Phase $E_3$ Backplane N is ASSERTED & Low
All other backplanes are DEASSERTED & High
Asserted segments are High
Deasserted segments are Low
Timeout period=$t_1$ Phase $F_3$ Backplane N is ASSERTED & High
All other backplanes are DEASSERTED & High
Asserted segments are High
Deasserted segments are High
Timeout period=$t_2$ These six phases translate to the states of a 'state machine' programmed on the microcontroller. That is, there are six states per backplane or 6N total states in the machine). The order of the aforementioned phase states is exemplary and it is contemplated and within the scope of the present invention that these states may be executed in any order so long as the resulting RMS voltages are the same, any phase state sequence is appropriate.

These states, as stated hereinbefore, do not need to be executed in any particular order as long as they are executed once per multiplex frame. The RMS calculations will work out the same. In this exemplary embodiment there are six phase states, and each backplane line needs its own set of six phase states (per activation); therefore, a system with N number of backplanes requires 6N states running on a digital logic circuit, e.g., microcontroller or programmable logic device.

The total time for a multiplex frame is different for a six phase embodiment than for the eight phase embodiments described herein. Using the definition for the constant C, from Equation 9:

$$T=(4t_i+2t_2)\cdot N=2N(2t_1+Ct_1)=2Nt_1(2+C) \quad \text{Equation 19}$$

Similarly, as before, $V_{Lo}$ and $V_{Hi}$ may be calculated by substituting in Equation 19 as needed:

$$V_{Lo} = \sqrt{\left(\frac{1}{T}\right)\cdot[2(N-1)t_1]\cdot V_r^2} = \sqrt{\frac{N-1}{N\cdot(2+C)}}\cdot V_r \quad \text{Equation 20}$$

$$V_{Hi} = \sqrt{\left(\frac{1}{T}\right)\cdot[4t_1+2(N-1)t_1]\cdot V_r^2} = \sqrt{\frac{N+1}{N\cdot(2+C)}}\cdot V_r \quad \text{Equation 21}$$

Since this is a Voff biasing embodiment, from Equation 20, set $V_{Lo}$=Voff and solve for C and 2+C:

$$2+C = \frac{V_r^2}{V_{off}^2}\cdot\frac{N-1}{N} \quad \text{Equation 22}$$

$$C = \frac{V_r^2}{V_{off}^2}\cdot\frac{N-1}{N} - 2 \quad \text{Equation 23}$$

From Equation 22, the minimum $V_{DD}$ that can be supported may be calculated. Setting C equal to zero, and setting Vr equal to $V_{DD\ min}$ gives:

$$V_{DD\ min} = \sqrt{\frac{2N}{N-1}}\cdot V_{off} \quad \text{Equation 24}$$

The maximum number of backplanes supportable may be calculated from Equation 21 by setting $V_{Hi}$ equal to Von, substituting 2+C from Equation 22 and solving for N, then setting N equal to Nmax yields:

$$N_{\max} = \frac{V_{off}^2 + V_{on}^2}{V_{on}^2 - V_{off}^2} \quad \text{Equation 25}$$

In this embodiment, $V_{DD\ min}$ is a function of N, the number of backplanes. Furthermore, the value of $V_{DD\ min}$ will go down with increasing N; that is, this embodiment becomes more robust with a larger number of backplanes. Nmax has Von squared in its numerator, so the number of backplanes supportable should be greater here than the eight phase embodiments described herein.

In order to avoid flicker, the minimum time period of $t_1$ must be determined. As before, $t_1$ needs to be a function of the refresh frequency, the number of backplanes in the LCD and the relation of the $t_1$ phase states to $t_2$ phase states. To calculate $t_2$, use Equation 9:

$$t_1 \leq \frac{1}{[2N(freq)(2+C)]} \quad \text{Equation 26}$$

Figure 5:
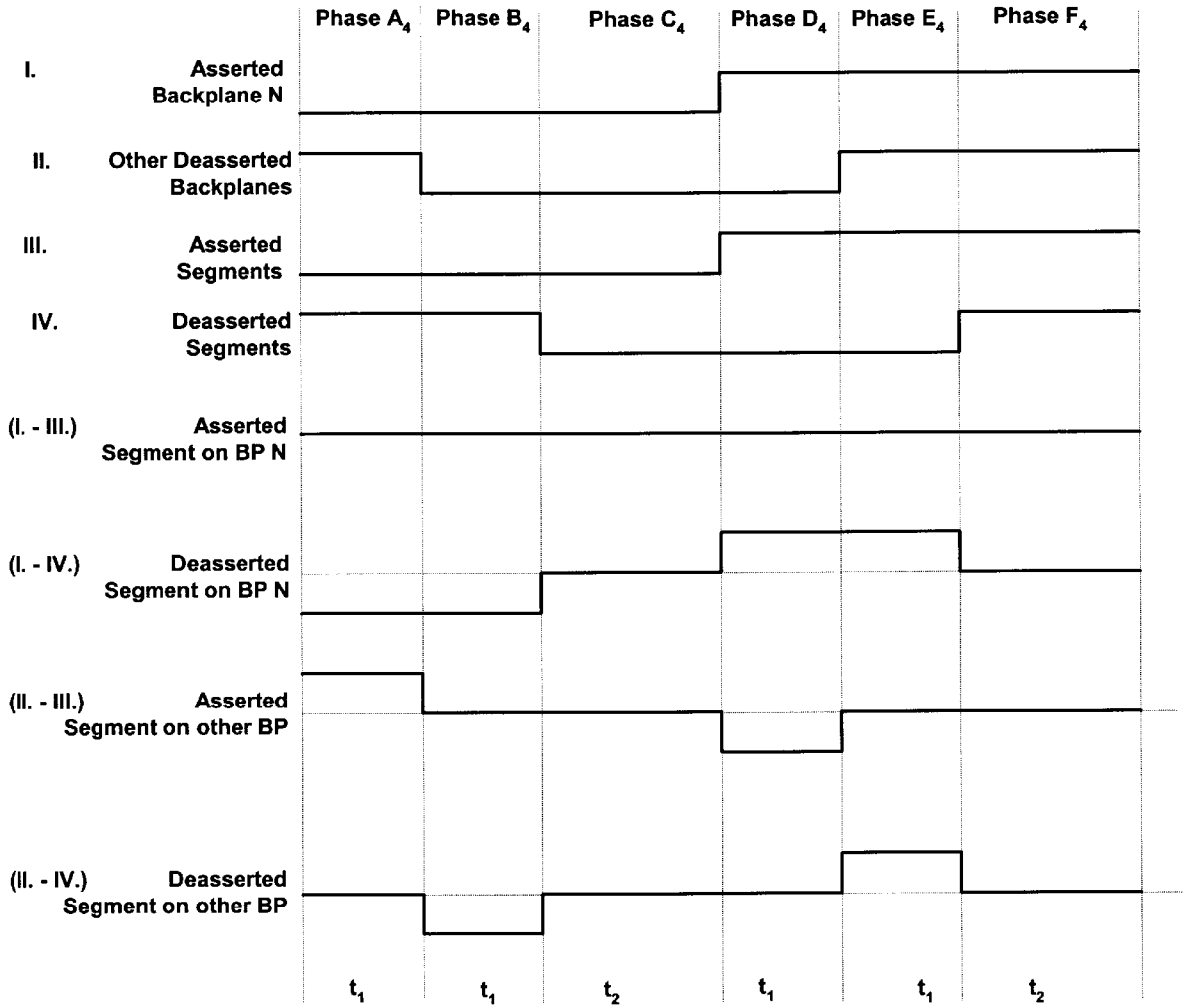
FIG. 5 illustrates an exemplary schematic timing diagram of yet another embodiment of the invention.

Referring now to FIG. 5, depicted is an exemplary schematic timing diagram of a 1:2 Von biased switched mode embodiment of the present invention. Six phases from the microcontroller 104, represented by Phase A4 through Phase $F_4$, sequentially drive the LCD glass 102 for each multiplex frame. These sequence of six phases are repeated for each backplane 102*a* on the LCD glass 102. The following steps are performed (and depicted in FIG. 5) in six phases (A4–F4) for Backplane N and then repeated for each subsequently asserted backplane.

This exemplary embodiment is the second of the 1:2 Switched-Mode digital logic circuit drivers for LCD glass. There are only six phase states required per backplane N. The term 'Von Biased' is defined herein as: Regardless of the supply voltage or the number of backplanes to be multiplexed, all pixels will be able to meet the Von specification. The Voff specification, however, will be affected by the number of backplanes to be supported and by the supply voltage.

The currently asserted backplane is designated Backplane N. 1:2 indicates that the asserted backplane is driven in 2 states while the deasserted backplane is only driven in one. These may be seen in the following phase state descriptions:

Phase A4

Backplane N is ASSERTED & Low
All other backplanes are DEASSERTED & High
Asserted segments are Low
Deasserted segments are High
Timeout period=$t_1$ Phase $B_4$ Backplane N is ASSERTED & Low
All other backplanes are DEASSERTED & Low
Asserted segments are Low
Deasserted segments are High
Timeout period=$t_1$ Phase $C_4$ Backplane N is ASSERTED & Low
All other backplanes are DEASSERTED & Low
Asserted segments are Low
Deasserted segments are Low
Timeout period=$t_2$ Phase $D_4$ Backplane N is ASSERTED & High
All other backplanes are DEASSERTED & Low
Asserted segments are High
Deasserted segments are Low
Timeout period=$t_1$ Phase $E_4$ Backplane N is ASSERTED & High
All other backplanes are DEASSERTED & High
Asserted segments are High
Deasserted segments are Low
Timeout period=$t_1$ Phase $F_4$ Backplane N is ASSERTED & High
All other backplanes are DEASSERTED & High
Asserted segments are High
Deasserted segments are High
Timeout period=$t_2$ The aforementioned phase states, do not need to be executed in any particular order as long as they are executed once per multiplex frame. The RMS calculations will work out the same. In this embodiment, there are six phase states per backplane N, therefore, a system with N number of backplanes requires 6N phase states running on the digital logic circuit, e.g., microcontroller or programmable logic device.

The total time for a multiplex frame is the same as before and Equation 19 may also be used for this embodiment. $V_{Lo}$ and $V_{Hi}$, by substituting into Equation 19 as needed:

$$V_{Lo} = \sqrt{\left(\frac{1}{T}\right)\cdot[2(N-1)t_1]\cdot V_r^2} = \sqrt{\frac{N-1}{N\cdot(2+C)}}\cdot V_r \quad \text{Equation 27}$$

$$V_{Hi} = \sqrt{\left(\frac{1}{T}\right)\cdot[4t_1 + 2(N-1)t_1]\cdot V_r^2} = \sqrt{\frac{N+1}{N\cdot(2+C)}}\cdot V_r \quad \text{Equation 28}$$

Note that Equations 27 and 28 are the same as Equations 20 and 21. This is true because the inversion of the backplane waveforms in phases A, B, D and E made no change to the resultant RMS voltage of the bottom four timing diagrams shown FIG. 4. According to the Von biasing embodiment herein, from Equation 28, set $V_{Hi}$=Von and solve for C and 2+C:

$$2 + C = \frac{V_r^2}{V_{on}^2}\cdot\frac{N+1}{N} \quad \text{Equation 29}$$

$$C = \frac{V_r^2}{V_{on}^2}\cdot\frac{N+1}{N} - 2 \quad \text{Equation 30}$$

From Equation 29, the minimum $V_{DD}$ that can be supported may be calculated. Setting C equal to zero, and setting Vr equal to $V_{DD\ min}$ yields:

$$V_{DD\ min} = \sqrt{\frac{2N}{N+1}} \cdot V_{on} \qquad \text{Equation 31}$$

The maximum number of backplanes supportable, may be calculated using Equation 26 by setting $V_{Lo}$ equal to Voff, substituting 2+C from Equation 29, solving for N and setting N equal to Nmax yields:

$$N_{max} = \frac{V_{off}^2 + V_{on}^2}{V_{on}^2 - V_{off}^2} \qquad \text{Equation 32}$$

$V_{DD\ min}$ is a function of N, the number of backplanes. Furthermore, the value of $V_{DD\ min}$ will go down with decreasing N; that is, this embodiment will becomes more robust with a smaller number of backplanes. Nmax has Von squared in its numerator, so the number of backplanes supportable may be greater here than the first two embodiments disclosed herein. Use Equation 25 for calculating $t_1$ and Equation 9 for $t_2$.

The 1:2 embodiments may be easier to implement than the 1:3 embodiments since there are two less phase states per multiplex frame. Requiring less phase states implies less coding in a microcontroller or programmable logic device. Also, having less phase states means a pixel that needs to be driven high, does not have to wait as long to be recharged; thus the 1:2 embodiments may be able to support a greater number of backplanes.

Table 2 represents a summary of the equations needed to implement the exemplary embodiments described herein. Table 3 represents a list of liquid crystal material manufacturers, the Von and Voff characteristics, and Nmax and $V_{DD\ min}$ calculations. Note that $V_{DD\ min}$ is shown with the maximum Nmax backplanes possible and with a nominal of 4 backplanes.

TABLE 2

| | $V_{DD\ min}$ = | $N_{max}$ = | $t_1 \leqq$ |
|---|---|---|---|
| 1:2 Voff Biased | $\sqrt{\frac{2N}{N-1}} \cdot V_{off}$ | $\frac{V_{off}^2 + V_{on}^2}{V_{on}^2 - V_{off}^2}$ | $\frac{1}{[2N(freq)(2+C)]}$ |
| 1:2 Von Biased | $\sqrt{\frac{2N}{N+1}} \cdot V_{on}$ | $\frac{V_{off}^2 + V_{on}^2}{V_{on}^2 - V_{off}^2}$ | $\frac{1}{[2N(freq)(2+C)]}$ |
| 1:3 Voff Biased | $\sqrt{3} \cdot V_{off}$ | $\frac{2V_{off}^2}{V_{on}^2 - V_{off}^2}$ | $\frac{1}{[2N(freq)(3+C)]}$ |
| 1:3 Von Biased | $\sqrt{\frac{3}{2}} \cdot V_{on}$ | $\frac{V_{on}^2}{V_{on}^2 - V_{off}^2}$ | $\frac{1}{[2N(freq)(3+C)]}$ |

Table 3 herein shows the performance comparisons of the four exemplary embodiments described herein. Note the backplane maximizing superiority of LCD fluids with small differences in their Von vs. Voff RMS voltages and the support of low $V_{DD\ min}$, voltages when a fluid with a low Voff specification is used.

TABLE 3

| | | | | 1:2 Von Biased | | | 1:2 Voff Biased | | | 1:3 Von Biased | | | 1:3 Von Biased | | |
|---|---|---|---|---|---|---|---|---|---|---|---|---|---|---|---|
| Company | Description | Voff | Von | N max | Vddmin @ Nmax | Vddmin @ N = 4 | N max | Vddmin @ Nmax | Vddmin @ N = 4 | N max | Vddmin @ Nmax | Vddmin @ N = 4 | N max | Vddmin @ Nmax | Vddmin @ N = 4 |
| All Shore | Commercial | 1.60 | 2.20 | 3 | 2.77 | | 3 | 2.69 | | 2 | 2.77 | | 2 | 2.69 | |
| All Shore | High Temp | 1.80 | 2.80 | 2 | 3.60 | | 2 | 3.23 | | 1 | 3.12 | | 1 | 3.43 | |
| Crystaloid | Fluid Name: A | 1.90 | 2.90 | 2 | 3.80 | | 2 | 3.35 | | 1 | 3.29 | | 1 | 3.55 | |
| Crystaloid | Fluid Name: B | 1.06 | 1.60 | 2 | 2.12 | | 2 | 1.85 | | 1 | 1.84 | | 1 | 1.96 | |
| Crystaloid | Fluid Name: G | 1.40 | 2.20 | 2 | 2.80 | | 2 | 2.54 | | 1 | 2.42 | | 1 | 2.69 | |
| Crystaloid | Fluid Name: H | 2.20 | 3.20 | 2 | 4.40 | | 2 | 3.70 | | 1 | 3.81 | | 1 | 3.92 | |
| Crystaloid | Fluid Name: J | 2.40 | 3.30 | 3 | 4.16 | | 3 | 4.04 | | 2 | 4.16 | | 2 | 4.04 | |
| Crystaloid | Fluid Name: M | 1.80 | 2.80 | 2 | 3.60 | | 2 | 3.23 | | 1 | 3.12 | | 1 | 3.43 | |
| Crustaloid | Fluid Name: S | 2.10 | 2.80 | 3 | 3.64 | | 3 | 3.43 | | 2 | 3.64 | | 2 | 3.43 | |
| DCI Inc. | Fluid Name: B | 1.93 | 2.59 | 3 | 3.34 | | 3 | 3.17 | | 2 | 3.34 | | 2 | 3.17 | |
| DCI Inc. | Fluid Name: C | 1.50 | 2.05 | 3 | 2.60 | | 3 | 2.51 | | 2 | 2.60 | | 2 | 2.51 | |
| DCI Inc. | Fluid Name: F | 2.30 | 3.20 | 3 | 3.98 | | 3 | 3.92 | | 2 | 3.98 | | 2 | 3.92 | |
| DCI Inc. | Fluid Name: G | 1.01 | 1.35 | 3 | 1.75 | | 3 | 1.65 | | 2 | 1.75 | | 2 | 1.65 | |
| DCI Inc. | Fluid Name: H | 1.23 | 1.67 | 3 | 2.13 | | 3 | 2.05 | | 2 | 2.13 | | 2 | 2.05 | |
| DCI Inc. | Fluid Name: I | 1.31 | 2.13 | 2 | 2.62 | | 2 | 2.46 | | 1 | 2.27 | | 1 | 2.61 | |
| DCI Inc. | Fluid Name: K | 1.46 | 2.04 | 3 | 2.53 | | 3 | 2.50 | | 2 | 2.53 | | 2 | 2.50 | |
| DCI Inc. | Fluid Name: L | 2.54 | 3.44 | 3 | 4.40 | | 3 | 4.21 | | 2 | 4.40 | | 2 | 4.21 | |
| LXD Inc. | Fluid Type: #1 | 1.98 | 3.10 | 2 | 3.96 | | 2 | 3.58 | | 1 | 3.43 | | 1 | 3.80 | |
| LXD Inc. | Fluid Type: #3 | 2.30 | 3.20 | 3 | 3.98 | | 3 | 3.92 | | 2 | 3.98 | | 2 | 3.92 | |
| LXD Inc. | Fluid Type: #4 | 1.24 | 1.80 | 2 | 2.48 | | 2 | 2.08 | | 1 | 2.15 | | 1 | 2.20 | |
| LXD Inc. | Fluid Tupe: #6 | 1.70 | 2.60 | 2 | 3.40 | | 2 | 3.00 | | 1 | 2.94 | | 1 | 3.18 | |
| LXD Inc. | Fluid Type: #12 | 1.24 | 1.80 | 2 | 2.48 | | 2 | 2.08 | | 1 | 2.15 | | 1 | 2.20 | |
| LXD Inc. | Fluid Type: #16 | 1.70 | 2.60 | 2 | 3.40 | | 2 | 3.00 | | 1 | 2.94 | | 1 | 3.18 | |
| LXD Inc. | Fluid Type: #18 | 2.75 | 3.00 | 11 | 4.08 | 4.49 | 11 | 4.06 | 3.79 | 10 | 4.76 | 4.76 | 6 | 3.67 | 3.67 |
| LXD Inc. | Fluid Type: #M2 | 2.75 | 3.00 | 11 | 4.08 | 4.49 | 11 | 4.06 | 3.79 | 10 | 4.76 | 4.76 | 6 | 3.67 | 3.67 |

Global Pixel Digital Contrast Control is a feature of the present invention. This feature comprises digital control of the LCD contrast. Traditional LCD circuits used potentiometers on the resistor ladder chain to adjust the overall contrast of the LCD device. Contrast control is now possible by merely adjusting the time interval, $t_2$. The mathematical effect of doing this alters the value of the constant, C. The higher the value of C, the longer the state machine stays in the $t_2$ interval; and so, as explained previously herein, the longer all the LCD pixels remain at a zero potential. This drops the bias on all the pixels, hence lowering the contrast of all of them.

Figure 6:
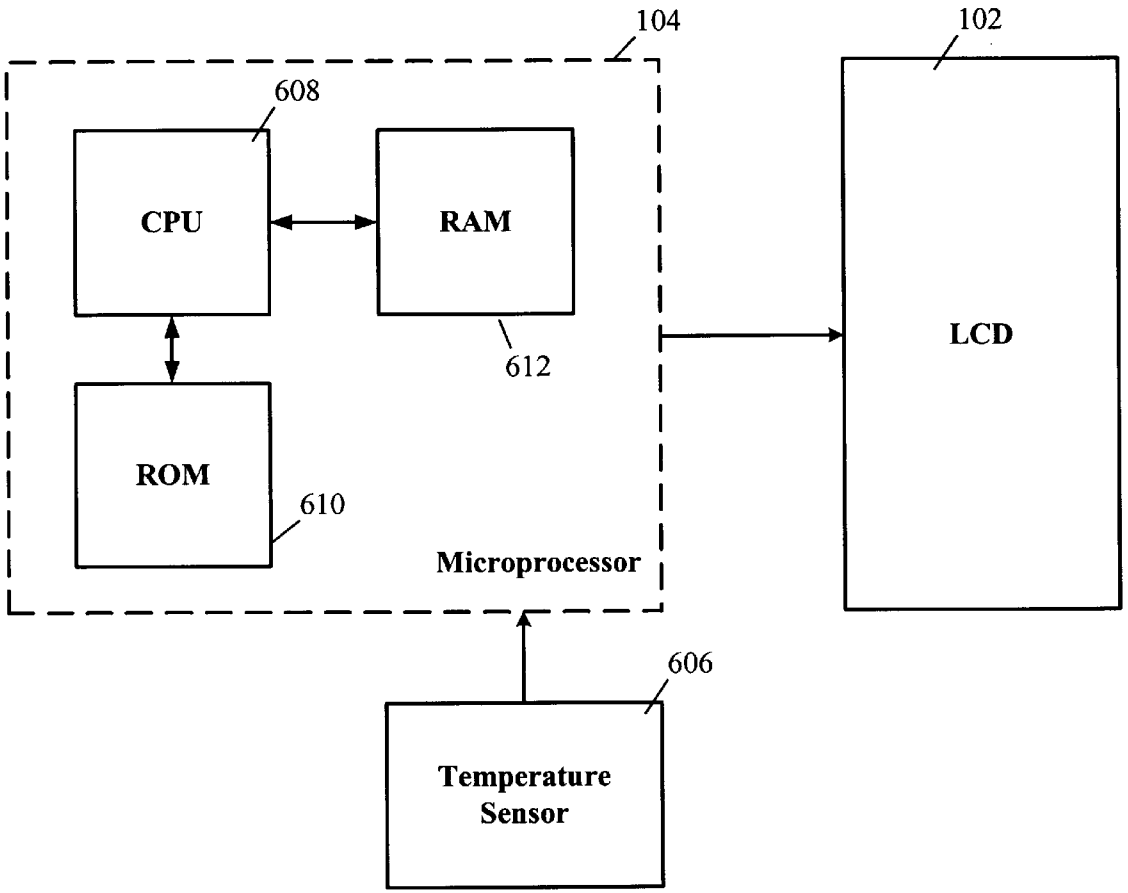
FIG. 6 illustrates a schematic block diagram of an exemplary embodiment of a temperature compensated directly driven LCD.

Referring to FIG. 6, depicted is a schematic block diagram of an exemplary embodiment of a temperature compensated directly driven LCD system. The LCD 102 is driven by a microprocessor 104. The microprocessor 104 comprises a central processing unit (CPU) 608, a random access memory (RAM) 612, and a read only memory (ROM) 610. The ROM 610 may be for example, but is not limited to, an electrically erasable and programmable ROM (EEPROM). A control program for the microcontroller 104 may be stored in the ROM 610, or may be stored in as firmware in a mask programmable ROM. A temperature sensor 606 may be used for measuring the environmental temperature of the LCD 102.

Global control of the LCD's contrast also allows for easy temperature compensation of the LCD glass. A restriction often encountered by LCD designers is that the values of Voff and Von drift with the ambient temperature. A microcontroller or programmable logic system equipped with a temperature sensor can compensate for variations in temperature by re-biasing the operating points of the LCD to the optimum for the current ambient temperature. Temperature compensation of the LCD glass in this manner is contemplated in the present invention and incorporated by reference herein.

Figure 7:
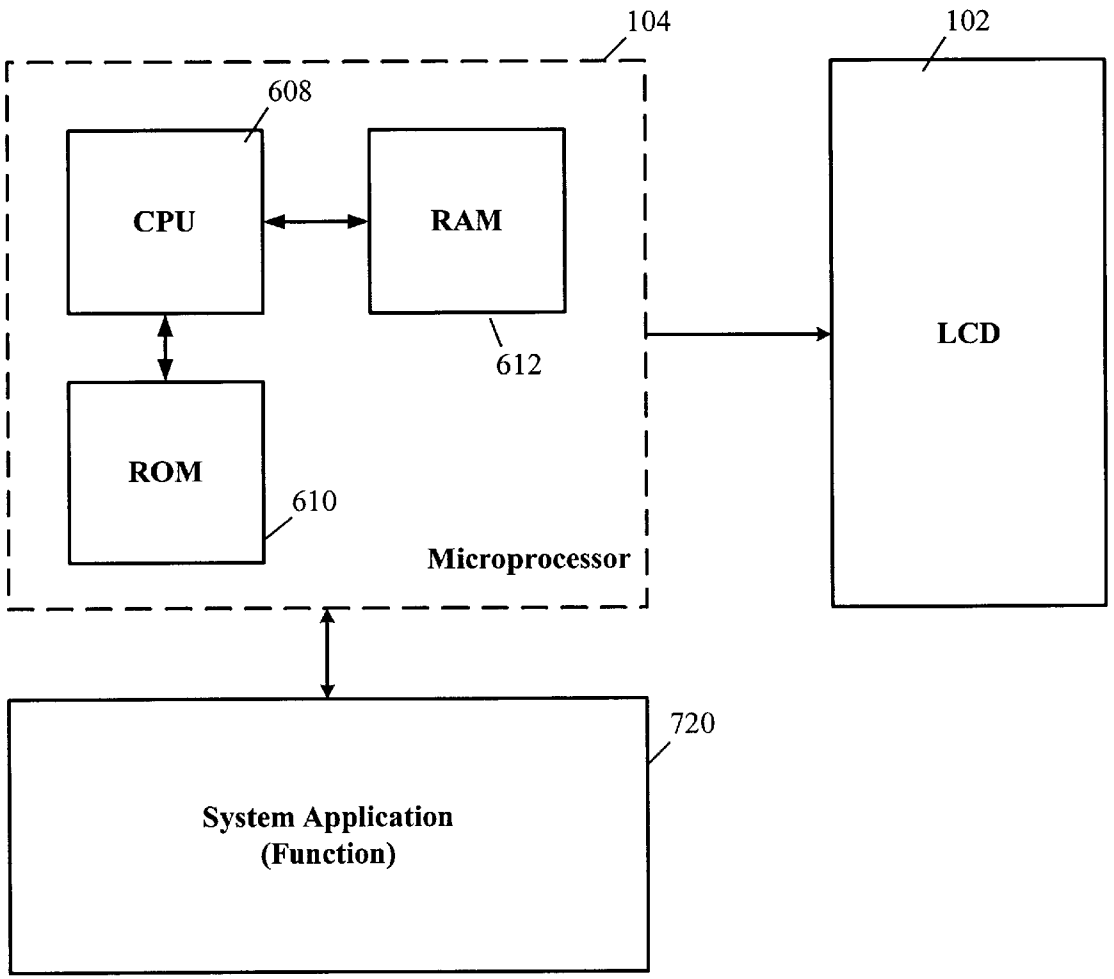
FIG. 7 illustrates a schematic block diagram of an exemplary embodiment of a system application using the microcontroller and having a directly driven LCD.

Referring to FIG. 7, depicted is a schematic block diagram of an exemplary embodiment of a system application using the microcontroller and having a directly driven LCD. The LCD 102 is driven by a microprocessor 104. The microprocessor 104 comprises a central processing unit (CPU) 608, a random access memory (RAM) 612, and a read only memory (ROM) 610. The ROM 610 may be for example but not limited to an electrically erasable and programmable ROM (EEPROM). A control program for the microcontroller 104 may be stored in the ROM 610, or may be stored in as firmware in a mask programmable ROM. The control program may be adapted for controlling the LCD and a system application (function) 720.

The system application 720 may be controlled by the microcontroller which may include, but is not limited to, control of temperature (thermostat), humidity, sprinkler, alarm and security system, alarm clock, timer, clothes dryer, washing machine, toaster, microwave, oven, cooktop, clothes iron, water heater, tankless water heater, solar heating, swimming pool, Jacuzzi, answering machine, pager, telephone, intercom, caller identification, electronic address book, treadmill, stationary bicycle, exercise machine, torque wrench, depth gauge, scale, speedometer, automobile tire condition status, anti-skid and anti-lock brakes, fuel gauge, engine monitoring, operation of luminaries (lights) in a building, power load management, video cassette player, DVD player, uninterruptable power supply (UPS), Dictaphone, tape recorder, MP3 music player, video game toy, calculator, personal digital organizer, etc.

Individual Pixel Digital Contrast Control is another feature of the present invention. It is possible for a particular pixel to have a mid-contrast gray level while others are at other Grey levels. It is quite easy to do this by dynamically modifying which segment lines are to be driven during the currently executing multiplex frame. That is, before each new multiplex frame is to begin, the microcontroller or programmable logic system determines if any given pixel that is to be asserted, should or should not actually be driven during this frame. This has the effect of time-domain 'dithering' individual pixels.

If an OFF pixel can be defined as having a contrast ratio of 0 and an ON pixel having a contrast ratio of 1, then this time domain dithering technique can produce pixel Grey levels with fractional contrast ratios between 0 and 1. For example, if a given pixel is to have a contrast ratio of ½ then it will be driven during every other multiplex frame; a pixel with a contrast ratio of ⅔, would be driven for 2 frames every 3. Two registers per pixel can be maintained to produce unique contrast levels for each pixel. The first register would hold the number of ON multiplex frames while the other held either the number of OFF frames or the total number of ON+OFF frames.

Referring now to Table 4, examples of current production microcontrollers are illustrated. Assume in Table 4 that ten I/O's are used for driving the backplane lines of an LCD. All of the other I/O's are assumed to drive segment signals. From this an exemplary number of supportable segments may be calculated. Note that in real applications not all pins of the microcontroller would be dedicated for LCD support; so, these are maximum numbers:

TABLE 4

| Microchip Part Number | Package Size | I/O pins | Backplanes | Segments | Maximum number of Segments Supportable |
|---|---|---|---|---|---|
| PIC16C620 | 18 pins | 13 | 10 | 3 | 30 |
| PIC16C62B | 28 pins | 22 | 10 | 12 | 120 |
| PIC16C65B | 40 pins | 33 | 10 | 23 | 230 |
| PIC17C756A | 64 pins | 50 | 10 | 40 | 400 |
| PIC18C858 | 80 pins | 68 | 10 | 58 | 580 |

As Table 4 illustrates, the present invention can support an LCD with over 500 segments. An advantage of the present invention is that no charge-pumps or resistor ladder network are required to drive the LCD glass.

The invention, therefore, is well adapted to carry out the objects and attain the ends and advantages mentioned, as well as others inherent therein. While the invention has been depicted, described, and is defined by reference to exemplary embodiments of the invention, such references do not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

ATTORNEY DOCKET NO. 068354.1121/MTI-1823

SWITCHED MODE TECHNIQUE FOR DRIVING LCD GLASS

APPENDIX A: SWITCHED MODE TECHNIQUE CODING EXAMPLE

```
;*********************************************************************
*
;     Notes:                                                          *
;                                                                       *
;     This application program is a example of the Time Averaging     *
;     Technique described in the specification attached hereto:     *
;     Using PIC Microcontroller General Purpose I/O pins to directly
;     drive LCD Glass.    *
;                                                                       *
;     This sample program is written for a particular LCD, all of     *
;     the mapping modules are specific for it. The user of this       *
;     code must reconfigure the mapping tables for his LCD appli-     *
;     cation. The number of backplanes for the LCD used here is       *
;     three, the user needs to add or subtract from the main loop     *
;     sequence to accommodate the number of backplanes in his          *
;     application.                                                    *
;                                                                       *
;     The common or backplane connections are on PORTA; while the     *
;     segment connections are on PORTB and PORTC. Please see the      *
;     mapping routines for a description of the connections.          *
;                                                                       *
;     Please note that since this code is written for the same        *
;     demo board that is used in Section A of the previously said     *
;     Application Brief, there are two I/O's associated with each     *
;     common line; however, in this code, both are driven at the      *
;     same polarity always.                                           *
;                                                                       *
;*********************************************************************
;                                                                       *
;                FUNCTIONAL DESCRIPTION OF THIS CODE                  *
;                                                                       *
;     The demo board associated with this code has a 3 backplane      *
;     LCD wired to general purpose I/O lines. The LCD has 3 7-seg-    *
;     ment digits that count up. The microcontroller is running at    *
;     20 MHz.                                                         *
;                                                                       *
;     A software PWM is setup using Timer1 interrupts. The commons    *
;     that are deasserted need to be at a mid voltage. This is done    *
;     with a software PWM running a 50% duty cycle. So, in the ISR    *
;     the designated mid-voltage commons are XOR'ed.                  *
;                                                                       *
;     Also in the ISR, the timing for the digit mux'ing is calc-      *
;     ulated as well as the timing of the display counters. The       *
;     phasing for the LCD is performed for both the positive and      *
;     negative frames. And when a new digit has ticked off, a         *
;     flag is set.                                                    *
;                                                                       *
;     In the MAIN loop, the number flag is detected and the BCD       *
;     number counters (3 digits) are incremented. The new count       *
;     is sent to the LCD mapping routines. Here, the BCD value        *
```

ATTORNEY DOCKET NO. 068354.1121/MTI-1823

```
;     is mapped to the pixels on the LCD.                    *
;                                                  *
;                                                                    *
;*********************************************************************

;*****      PROCESSOR CONFIGURATION & ASSEMBLER SETUPS

   list      p=16f876          ;list directive to define processor
   #include <p16f876.inc>      ;processor specific variable definitions

CONFIG_1 equ _CP_OFF & _WDT_OFF & _BODEN_OFF & _PWRTE_ON & _HS_OSC
CONFIG_2 equ _WRT_ENABLE_OFF & _LVP_OFF & _DEBUG_OFF & _CPD_OFF

   __CONFIG CONFIG_1 & CONFIG_2


;***** VARIABLE DEFINITIONS

      cblock      0x70  ;ISR variables

            w_temp            ;variable used for context saving
            status_temp       ;variable used for context saving

            endc


      cblock      0x20  ;General Purpose Variables

            rtc         ;RTC register, overflows every digit change
            digit:3           ;3 BCD registers for count display

            seg_PB:3          ;segments on PORTB      (index by common)
            seg_PC:3          ;segments on PORTC              "
            iseg_PB:3   ;inverted segments on PORTB   "
            iseg_PC:3   ;inverted segments on PORTC   "

            refresh           ;counter for backplane refresh
            PWMmask           ;mask for inverting 2.5v bits

            tick_flag   ;flag to increment display in main loop
            frame       ;state machine variable for mux phase

            contrastL   ;contrast adj registers (lsb)
            contrastH   ; 16 bit (msb)
            c_lim_top   ;     adjustment stop upper
            c_lim_bot   ;     adjustment stop lower

            endc

;*********************************************************************
;*********************************************************************
;
;     Duty Cycle Calculations
;
;     The LCD used on this demo board has the following specs:
;
;           Voff = 1.15 Vrms  Von = 1.48 Vrms
;
```

ATTORNEY DOCKET NO. 068354.1121/MTI-1823

```
;     1) First C must be calculated (see the app note write-up):
;
;          C = (Vr^2 - 3*Voff^2)/(Voff^2) = 15.9035
;                    where Vr=5v
;
;     2) Next t1 is calculated:
;
;          t1 = 1/[ 2*N*Freq*(3+C)] = 110uS
;                    where Freq=80 Hz and N=3
;
;          for an instruction clock of 5MHz, this represents:
;          (5*10^6)*(110*10^-6)=551 (0x227) clock ticks of TMR1
;
;          since TMR1 only counts up, preload TMR1 with:
;          0x10000-0x227=0xFDD9 to get 551 clocks til interrupt
;
;
;     3) Finally, to calculate t2:
;
;          t2 = t1 * C = 8763 (0x223A) clock ticks on TMR1
;
;          since TMR1 only counts up, preload TMR1 with:
;          0x10000-0x223A=0xDDC6 to get 8763 clock til interrupt
;

t1_L  equ   0xd9
t1_H  equ   0xfd

t2_L  equ   0xc6
t2_H  equ   0xdd

;*********************************************************************
;*********************************************************************
;
;     RESET
;
;*********************************************************************
;
      ORG     0x000      ;processor reset vector
      nop                ;needed for ICD debug mode
      clrf    PCLATH     ;ensure page bits are cleared
      goto    setup      ;go to beginning of program


;*********************************************************************
;*********************************************************************
;
;     INTERRUPT SERVICE ROUTINE
;
;*********************************************************************
;
      ORG     0x004            ;interrupt vector location
      movwf   w_temp           ;save off current W register contents
      movf  STATUS,w           ;move status register into W register
      movwf status_temp ;save off contents of STATUS register


;Update Real time clock registers
```

```
        decfsz      rtc,f          ;250 counts = 1 tick
        goto  phase_state_dly      ;   not done yet

                              ;   done:
        movlw .250            ;     preset RTC counter .250 = 1 tick
        movwf rtc             ;      ( 1 tick = (250Hz) / 250 )

        bsf   tick_flag,0 ;     set display count flag
        goto  phase_state ;


phase_state_dly:                   ;adjust timing to match
        nop                   ;  4 instructions above
        nop                   ;
        goto  phase_state ;  (to avoid DC offset in LCD)


;
;*********************************************************************
;
;       Phase State Machine Loop      Step thru all 24 LCD phases
;
;       These states are in 3 subsets, one subset for each Backplane. The
;       backplanes are numbered 0 to 2. Each subset has 8 phases, these
are
;       labled phase A thru phase H.
;
;       Phases A - C are the positive subframes for the LCD sequencing.
;       Phases E - F are the negative subframes for the LCD sequencing.
;       Phases D & H are used to set the contrast point of the LCD; these
;       frames use the timing interval t2. All other frames use timing
;       interval t1. A full description of these frames are in the body
;       the Application Brief.
;
;       These 24 phases together make one LCD multiplex frame
;
;       Note:
;             If the LCD had greater or less backplanes, the total
;             number of these phases needs to be adjusted; the user
;             can cut and paste as required.
;
;             IMPORTANT: This ISR code is written so that the path
;             length is the same no matter what branches are taken.
;             This is done to ensure no DC offset in the LCD. Any
;             changes in this module must maintain this requirement.
;

phase_state:

        incf  frame,f             ;load next phase state
        movlw .24             ;  Is result > 23
        subwf frame,w             ;
        btfsc STATUS,C        ;
        clrf  frame           ;    yes, it is > 23, so reset to 0
        movf  frame,w             ;       move frame number to w

        addwf PCL,f           ;state machine computed GOTO

        goto  phase_0A        ;0    pos sub-frame, bp 0, phase A
        goto  phase_0B        ;1    pos sub-frame, bp 0, phase B
```

```
        goto  phase_0C     ;2    pos sub-frame, bp 0, phase C
        goto  phase_0D     ;3    pos sub-frame, bp 0, phase D
        goto  phase_0E     ;4    neg sub-frame, bp 0, phase E
        goto  phase_0F     ;5    neg sub-frame, bp 0, phase F
        goto  phase_0G     ;6    neg sub-frame, bp 0, phase G
        goto  phase_0H     ;7    neg sub-frame, bp 0, phase H

        goto  phase_1A     ;8    pos sub-frame, bp 1, phase A
        goto  phase_1B     ;9    pos sub-frame, bp 1, phase B
        goto  phase_1C     ;10   pos sub-frame, bp 1, phase C
        goto  phase_1D     ;11   pos sub-frame, bp 1, phase D
        goto  phase_1E     ;12   neg sub-frame, bp 1, phase E
        goto  phase_1F     ;13   neg sub-frame, bp 1, phase F
        goto  phase_1G     ;14   neg sub-frame, bp 1, phase G
        goto  phase_1H     ;15   neg sub-frame, bp 1, phase H

        goto  phase_2A     ;16   pos sub-frame, bp 2, phase A
        goto  phase_2B     ;17   pos sub-frame, bp 2, phase B
        goto  phase_2C     ;18   pos sub-frame, bp 2, phase C
        goto  phase_2D     ;19   pos sub-frame, bp 2, phase D
        goto  phase_2E     ;20   neg sub-frame, bp 2, phase E
        goto  phase_2F     ;21   neg sub-frame, bp 2, phase F
        goto  phase_2G     ;22   neg sub-frame, bp 2, phase G
        goto  phase_2H     ;23   neg sub-frame, bp 2, phase H


;****************************** LCD BP0 Asserted, Pos Sub-Frame, Phase A

phase_0A:
        movf  seg_PB+0,w   ;Asserted Low seg data to portb
        movwf PORTB        ;     Deasserted segs are High
        movf  seg_PC+0,w   ;Asserted Low seg data to portc
        movwf PORTC        ;     Deasserted segs are High

        movlw b'00111111'  ;com0 high & other BP high
        movwf PORTA        ;

        movlw t1_L         ;Preset Timer for t1 Duty cycle interval
        addwf TMR1L,f            ;
        btfsc STATUS,C     ;
        incf  TMR1H,f            ;
        movlw t1_H         ;
        addwf TMR1H,f            ;

        goto  ISR_done           ;done servicing LCD phasing

;****************************** LCD BP0 Asserted, Pos Sub-Frame, Phase B

phase_0B:
        movf  seg_PB+0,w   ;Asserted Low seg data to portb
        movwf PORTB        ;     Deasserted segs are High
        movf  seg_PC+0,w   ;Asserted Low seg data to portc
        movwf PORTC        ;     Deasserted segs are High

        movlw b'00000011'  ;com0 high & other BP low
        movwf PORTA        ;

        movlw t1_L         ;Preset Timer for t1 Duty cycle interval
        addwf TMR1L,f            ;
        btfsc STATUS,C     ;
```

ATTORNEY DOCKET NO. 068354.1121/MTI-1823

```
      incf  TMR1H,f           ;
      movlw t1_H        ;
      addwf TMR1H,f           ;

      goto  ISR_done          ;done servicing LCD phasing

;****************************** LCD BPO Asserted, Pos Sub-Frame, Phase C

phase_0C:
      movlw 0x0         ;Asserted Low seg data to portb
      movwf PORTB       ;     Deasserted segs are Low
      movlw 0x0         ;Asserted Low seg data to portc
      movwf PORTC       ;     Deasserted segs are Low

      movlw b'00000011' ;com0 high & other BP low
      movwf PORTA       ;

      movlw t1_L        ;Preset Timer for t1 Duty cycle interval
      addwf TMR1L,f           ;
      btfsc STATUS,C    ;
      incf  TMR1H,f           ;
      movlw t1_H        ;
      addwf TMR1H,f           ;

      goto  ISR_done          ;done servicing LCD phasing

;****************************** LCD BPO Asserted, Pos Sub-Frame, Phase D

phase_0D:
      movlw 0x0         ;Asserted Low seg data to portb
      movwf PORTB       ;     Deasserted segs are High
      movlw 0x0         ;Asserted Low seg data to portc
      movwf PORTC       ;     Deasserted segs are High

      movlw b'00000000' ;com0 low & other BP low
      movwf PORTA       ;

      movf  contrastL,w ;Preset Timer for t2 Duty cycle interval
      addwf TMR1L,f           ;  (Contrast Adj cycle)
      btfsc STATUS,C    ;
      incf  TMR1H,f           ;
      movf  contrastH,w ;
      addwf TMR1H,f           ;

      goto  ISR_done          ;done servicing LCD phasing

;****************************** LCD BPO Asserted, Neg Sub-Frame, Phase E

phase_0E:
      movf  iseg_PB+0,w ;Asserted High seg data to portb
      movwf PORTB       ;     Deasserted segs are Low
      movf  iseg_PC+0,w ;Asserted High seg data to portc
      movwf PORTC       ;     Deasserted segs are Low

      movlw b'00000000' ;com0 low & other BP low
      movwf PORTA       ;

      movlw t1_L        ;Preset Timer for t1 Duty cycle interval
      addwf TMR1L,f           ;
      btfsc STATUS,C    ;
      incf  TMR1H,f           ;
```

```
        movlw t1_H          ;
        addwf TMR1H,f           ;

        goto  ISR_done          ;done servicing LCD phasing

;****************************** LCD BPO Asserted, Neg Sub-Frame, Phase F

phase_OF:
        movf  iseg_PB+0,w ;Asserted High seg data to portb
        movwf PORTB         ;     Deasserted segs are Low
        movf  iseg_PC+0,w ;Asserted High seg data to portc
        movwf PORTC         ;     Deasserted segs are Low

        movlw b'00111100' ;com0 low & other BP high
        movwf PORTA         ;

        movlw t1_L          ;Preset Timer for t1 Duty cycle interval
        addwf TMR1L,f           ;
        btfsc STATUS,C      ;
        incf  TMR1H,f           ;
        movlw t1_H          ;
        addwf TMR1H,f           ;

        goto  ISR_done          ;done servicing LCD phasing

;****************************** LCD BPO Asserted, Neg Sub-Frame, Phase G

phase_OG:
        movlw 0xFF          ;Asserted Low seg data to portb
        movwf PORTB         ;     Deasserted segs are Low
        movlw 0xFF          ;Asserted Low seg data to portc
        movwf PORTC         ;     Deasserted segs are Low

        movlw b'00111100' ;com0 low & other BP high
        movwf PORTA         ;

        movlw t1_L          ;Preset Timer for t1 Duty cycle interval
        addwf TMR1L,f           ;
        btfsc STATUS,C      ;
        incf  TMR1H,f           ;
        movlw t1_H          ;
        addwf TMR1H,f           ;

        goto  ISR_done          ;done servicing LCD phasing

;****************************** LCD BPO Asserted, Neg Sub-Frame, Phase H

phase_OH:
        movlw 0xFF          ;Asserted High seg data to portb
        movwf PORTB         ;     Deasserted segs are High
        movlw 0xFF          ;Asserted High seg data to portc
        movwf PORTC         ;     Deasserted segs are High

        movlw b'00111111' ;com0 High & other BP High
        movwf PORTA         ;

        movf  contrastL,w ;Preset Timer for t2 Duty cycle interval
        addwf TMR1L,f           ;  (Contrast Adj cycle)
        btfsc STATUS,C      ;
        incf  TMR1H,f           ;
        movf  contrastH,w ;
```

ATTORNEY DOCKET NO. 068354.1121/MTI-1823

```
        addwf TMR1H,f           ;

        goto  ISR_done          ;done servicing LCD phasing

;****************************** LCD BP1 Asserted, Pos Sub-Frame, Phase A

phase_1A:
        movf  seg_PB+1,w  ;Asserted Low seg data to portb
        movwf PORTB       ;     Deasserted segs are High
        movf  seg_PC+1,w  ;Asserted Low seg data to portc
        movwf PORTC       ;     Deasserted segs are High

        movlw b'00111111' ;com1 high & other BP high
        movwf PORTA       ;

        movlw t1_L        ;Preset Timer for t1 Duty cycle interval
        addwf TMR1L,f           ;
        btfsc STATUS,C    ;
        incf  TMR1H,f           ;
        movlw t1_H        ;
        addwf TMR1H,f           ;

        goto  ISR_done          ;done servicing LCD phasing

;****************************** LCD BP1 Asserted, Pos Sub-Frame, Phase B

phase_1B:
        movf  seg_PB+1,w  ;Asserted Low seg data to portb
        movwf PORTB       ;     Deasserted segs are High
        movf  seg_PC+1,w  ;Asserted Low seg data to portc
        movwf PORTC       ;     Deasserted segs are High

        movlw b'00001100' ;com1 high & other BP low
        movwf PORTA       ;

        movlw t1_L        ;Preset Timer for t1 Duty cycle interval
        addwf TMR1L,f           ;
        btfsc STATUS,C    ;
        incf  TMR1H,f           ;
        movlw t1_H        ;
        addwf TMR1H,f           ;

        goto  ISR_done          ;done servicing LCD phasing

;****************************** LCD BP1 Asserted, Pos Sub-Frame, Phase C

phase_1C:
        movlw 0x0         ;Asserted Low seg data to portb
        movwf PORTB       ;     Deasserted segs are Low
        movlw 0x0         ;Asserted Low seg data to portc
        movwf PORTC       ;     Deasserted segs are Low

        movlw b'00001100' ;com1 high & other BP low
        movwf PORTA       ;

        movlw t1_L        ;Preset Timer for t1 Duty cycle interval
        addwf TMR1L,f           ;
        btfsc STATUS,C    ;
        incf  TMR1H,f           ;
        movlw t1_H        ;
```

ATTORNEY DOCKET NO. 068354.1121/MTI-1823

```
      addwf TMR1H,f           ;

      goto  ISR_done          ;done servicing LCD phasing

;****************************** LCD BP1 Asserted, Pos Sub-Frame, Phase D

phase_1D:
      movlw 0x0          ;Asserted Low seg data to portb
      movwf PORTB        ;     Deasserted segs are High
      movlw 0x0          ;Asserted Low seg data to portc
      movwf PORTC        ;     Deasserted segs are High

      movlw b'00000000'  ;com1 low & other BP low
      movwf PORTA        ;

      movf  contrastL,w  ;Preset Timer for t2 Duty cycle interval
      addwf TMR1L,f           ;  (Contrast Adj cycle)
      btfsc STATUS,C     ;
      incf  TMR1H,f           ;
      movf  contrastH,w  ;
      addwf TMR1H,f           ;

      goto  ISR_done          ;done servicing LCD phasing

;****************************** LCD BP1 Asserted, Neg Sub-Frame, Phase E

phase_1E:
      movf  iseg_PB+1,w  ;Asserted High seg data to portb
      movwf PORTB        ;     Deasserted segs are Low
      movf  iseg_PC+1,w  ;Asserted High seg data to portc
      movwf PORTC        ;     Deasserted segs are Low

      movlw b'00000000'  ;com1 low & other BP low
      movwf PORTA        ;

      movlw t1_L         ;Preset Timer for t1 Duty cycle interval
      addwf TMR1L,f           ;
      btfsc STATUS,C     ;
      incf  TMR1H,f           ;
      movlw t1_H         ;
      addwf TMR1H,f           ;

      goto  ISR_done          ;done servicing LCD phasing

;****************************** LCD BP1 Asserted, Neg Sub-Frame, Phase F

phase_1F:
      movf  iseg_PB+1,w  ;Asserted High seg data to portb
      movwf PORTB        ;     Deasserted segs are Low
      movf  iseg_PC+1,w  ;Asserted High seg data to portc
      movwf PORTC        ;     Deasserted segs are Low

      movlw b'00110011'  ;com1 low & other BP high
      movwf PORTA        ;

      movlw t1_L         ;Preset Timer for t1 Duty cycle interval
      addwf TMR1L,f           ;
      btfsc STATUS,C     ;
      incf  TMR1H,f           ;
      movlw t1_H         ;
      addwf TMR1H,f           ;
```

```
      goto  ISR_done          ;done servicing LCD phasing

;****************************** LCD BP1 Asserted, Neg Sub-Frame, Phase G

phase_1G:
      movlw OxFF        ;Asserted High seg data to portb
      movwf PORTB       ;     Deasserted segs are High
      movlw OxFF        ;Asserted High seg data to portc
      movwf PORTC       ;     Deasserted segs are High

      movlw b'00110011' ;com1 low & other BP high
      movwf PORTA       ;

      movlw t1_L        ;Preset Timer for t1 Duty cycle interval
      addwf TMR1L,f           ;
      btfsc STATUS,C    ;
      incf  TMR1H,f           ;
      movlw t1_H        ;
      addwf TMR1H,f           ;

      goto  ISR_done          ;done servicing LCD phasing

;****************************** LCD BP1 Asserted, Neg Sub-Frame, Phase H

phase_1H:
      movlw OxFF        ;Asserted High seg data to portb
      movwf PORTB       ;     Deasserted segs are High
      movlw OxFF        ;Asserted High seg data to portc
      movwf PORTC       ;     Deasserted segs are High

      movlw b'00111111' ;com1 high & other BP high
      movwf PORTA       ;

      movf  contrastL,w ;Preset Timer for t2 Duty cycle interval
      addwf TMR1L,f           ;  (Contrast Adj cycle)
      btfsc STATUS,C    ;
      incf  TMR1H,f           ;
      movf  contrastH,w ;
      addwf TMR1H,f           ;

      goto  ISR_done          ;done servicing LCD phasing

;****************************** LCD BP2 Asserted, Pos Sub-Frame, Phase A

phase_2A:
      movf  seg_PB+2,w  ;Asserted Low seg data to portb
      movwf PORTB       ;     Deasserted segs are High
      movf  seg_PC+2,w  ;Asserted Low seg data to portc
      movwf PORTC       ;     Deasserted segs are High

      movlw b'00111111' ;com2 high & other BP high
      movwf PORTA       ;

      movlw t1_L        ;Preset Timer for t1 Duty cycle interval
      addwf TMR1L,f           ;
      btfsc STATUS,C    ;
      incf  TMR1H,f           ;
      movlw t1_H        ;
      addwf TMR1H,f           ;
```

```
        goto  ISR_done          ;done servicing LCD phasing

;****************************** LCD BP2 Asserted, Pos Sub-Frame, Phase B

phase_2B:
        movf  seg_PB+2,w  ;Asserted Low seg data to portb
        movwf PORTB       ;     Deasserted segs are High
        movf  seg_PC+2,w  ;Asserted Low seg data to portc
        movwf PORTC       ;     Deasserted segs are High

        movlw b'00110000' ;com2 high & other BP low
        movwf PORTA       ;

        movlw t1_L        ;Preset Timer for t1 Duty cycle interval
        addwf TMR1L,f           ;
        btfsc STATUS,C    ;
        incf  TMR1H,f           ;
        movlw t1_H        ;
        addwf TMR1H,f           ;

        goto  ISR_done          ;done servicing LCD phasing

;****************************** LCD BP2 Asserted, Pos Sub-Frame, Phase C

phase_2C:
        movlw 0x0         ;Asserted Low seg data to portb
        movwf PORTB       ;     Deasserted segs are Low
        movlw 0x0         ;Asserted Low seg data to portc
        movwf PORTC       ;     Deasserted segs are Low

        movlw b'00110000' ;com2 high & other BP low
        movwf PORTA       ;

        movlw t1_L        ;Preset Timer for t1 Duty cycle interval
        addwf TMR1L,f           ;
        btfsc STATUS,C    ;
        incf  TMR1H,f           ;
        movlw t1_H        ;
        addwf TMR1H,f           ;

        goto  ISR_done          ;done servicing LCD phasing

;****************************** LCD BP2 Asserted, Pos Sub-Frame, Phase D

phase_2D:
        movlw 0x0         ;Asserted Low seg data to portb
        movwf PORTB       ;     Deasserted segs are High
        movlw 0x0         ;Asserted Low seg data to portc
        movwf PORTC       ;     Deasserted segs are High

        movlw b'00000000' ;com2 low & other BP low
        movwf PORTA       ;

        movf  contrastL,w ;Preset Timer for t2 Duty cycle interval
        addwf TMR1L,f           ;  (Contrast Adj cycle)
        btfsc STATUS,C    ;
        incf  TMR1H,f           ;
        movf  contrastH,w ;
        addwf TMR1H,f           ;
```

ATTORNEY DOCKET NO. 068354.1121/MTI-1823

```
      goto  ISR_done          ;done servicing LCD phasing

;****************************** LCD BP2 Asserted, Neg Sub-Frame, Phase E

phase_2E:
      movf  iseg_PB+2,w ;Asserted High seg data to portb
      movwf PORTB       ;     Deasserted segs are Low
      movf  iseg_PC+2,w ;Asserted High seg data to portc
      movwf PORTC       ;     Deasserted segs are Low

      movlw b'00000000' ;com2 low & other BP low
      movwf PORTA       ;

      movlw t1_L        ;Preset Timer for t1 Duty cycle interval
      addwf TMR1L,f           ;
      btfsc STATUS,C    ;
      incf  TMR1H,f           ;
      movlw t1_H        ;
      addwf TMR1H,f           ;

      goto  ISR_done          ;done servicing LCD phasing

;****************************** LCD BP2 Asserted, Neg Sub-Frame, Phase F

phase_2F:
      movf  iseg_PB+2,w ;Asserted High seg data to portb
      movwf PORTB       ;     Deasserted segs are Low
      movf  iseg_PC+2,w ;Asserted High seg data to portc
      movwf PORTC       ;     Deasserted segs are Low

      movlw b'00001111' ;com2 low & other BP high
      movwf PORTA       ;

      movlw t1_L        ;Preset Timer for t1 Duty cycle interval
      addwf TMR1L,f           ;
      btfsc STATUS,C    ;
      incf  TMR1H,f           ;
      movlw t1_H        ;
      addwf TMR1H,f           ;

      goto  ISR_done          ;done servicing LCD phasing

;****************************** LCD BP2 Asserted, Neg Sub-Frame, Phase G

phase_2G:
      movlw 0xFF        ;Asserted High seg data to portb
      movwf PORTB       ;     Deasserted segs are High
      movlw 0xFF        ;Asserted High seg data to portc
      movwf PORTC       ;     Deasserted segs are High

      movlw b'00001111' ;com2 low & other BP high
      movwf PORTA       ;

      movlw t1_L        ;Preset Timer for t1 Duty cycle interval
      addwf TMR1L,f           ;
      btfsc STATUS,C    ;
      incf  TMR1H,f           ;
      movlw t1_H        ;
      addwf TMR1H,f           ;

      goto  ISR_done          ;done servicing LCD phasing
```

ATTORNEY DOCKET NO. 068354.1121/MTI-1823

```
;****************************** LCD BP2 Asserted, Neg Sub-Frame, Phase H

phase_2H:
      movlw 0xFF          ;Asserted High seg data to portb
      movwf PORTB         ;     Deasserted segs are High
      movlw 0xFF          ;Asserted High seg data to portc
      movwf PORTC         ;     Deasserted segs are High

      movlw b'00111111'   ;com2 high & other BP high
      movwf PORTA         ;

      movf  contrastL,w   ;Preset Timer for t2 Duty cycle interval
      addwf TMR1L,f             ;  (Contrast Adj cycle)
      btfsc STATUS,C      ;
      incf  TMR1H,f             ;
      movf  contrastH,w   ;
      addwf TMR1H,f             ;

      goto  ISR_done            ;done servicing LCD phasing


;*********************************************************************
;

ISR_done:

      clrf  PIR1          ;reset int flag

      ;**** prepare for return from ISR

      movf    status_temp,w     ;retrieve copy of STATUS register
      movwf STATUS              ;restore pre-isr STATUS register contents
      swapf   w_temp,f
      swapf   w_temp,w          ;restore pre-isr W register contents
      retfie                    ;return from interrupt


;*********************************************************************
;*********************************************************************


;*********************************************************************
;
;     Initialize processor environment - RESET code starts here
;
;*********************************************************************
;

setup

;***  Setup ports, digit & segment registers

      clrf  PORTA         ;all ports to low
      clrf  PORTB
      clrf  PORTC

      clrf  digit+0             ;init digits to 000
      clrf  digit+1
      clrf  digit+2
```

ATTORNEY DOCKET NO. 068354.1121/MTI-1823

```
        movlw 0x0           ;segment coding for 'all on'
        movwf seg_PB+0
        movwf seg_PB+1
        movwf seg_PB+2
        movwf seg_PC+0
        movwf seg_PC+1
        movwf seg_PC+2

        movlw 0xff          ;inversion coding for 'all on'
        movwf iseg_PB+0
        movwf iseg_PB+1
        movwf iseg_PB+2
        movwf iseg_PC+0
        movwf iseg_PC+1
        movwf iseg_PC+2

        banksel     TRISA       ;all ports to output
        clrf  TRISA         ;
        clrf  TRISB         ;
        movlw 0x03          ;C0 and C1 are digital contrast
        movwf TRISC         ; control inputs, all others output

        movlw 0x07          ;all porta pin as digital i/o
        movwf ADCON1


;***    Timing and Interrupt Setups

        banksel     TMR1H

        movlw t2_L          ;Preset Timer for 8kHz PWM Vmid generator
        movwf contrastL     ;  (20MHz /4  /625 = 8kHz)
        movlw t2_H          ;
        movwf contrastH     ;

        movlw .32           ;Calculate bottom limit of contrast adj allowed
        subwf contrastH,w   ;
        movwf c_lim_bot     ;

        movlw .32           ;Calculate top limit of contrast adj allowed
        addwf contrastH,w   ;
        movwf c_lim_top     ;

        movlw .250          ;preset real time clock counter .250 = 1 tick
        movwf rtc           ; ( 1 tick = (8KHz/32, see refresh above) / 250
)

        banksel     PIE1
        bsf   PIE1,TMR1IE   ;allow TMR1 interrupts

        banksel     T1CON
        movlw 0x01          ;TMR1 On, Int Source, No int sync,
        movwf T1CON         ;Osc driver Off, 1:1 prescaler

        bsf   INTCON,PEIE   ;enable peripheral interrupts
        bsf   INTCON,GIE    ;enable interrupt


;*********************************************************************
;
```

ATTORNEY DOCKET NO. 068354.1121/MTI-1823

```
;     MAIN LOOP - Wait for tick flag then change LCD pixel pattern
;
;*********************************************************************
;

main:
      btfsc tick_flag,0 ;has count ticked off yet?
      goto  kount       ; yes, update display

      btfss PORTC,0           ;contrast down pressed?
      goto  cont_dn           ; yes, go adjust downward

      btfss PORTC,1           ;contrast up pressed?
      goto  cont_up           ; yes, go adjust upward

      goto  main        ;no changes, loop back


cont_up:                ;Increase contrast command from user
      movlw 0x1         ;
      addwf contrastH,f ;

      movf  c_lim_top,w ;check for limit stop
      subwf contrastH,w ;
      btfsc STATUS,Z    ; if contrastH = c_lim_top
      goto  cont_dn           ;   then drop it down one notch

      btfss tick_flag,0 ;debounce; has one count ticked off yet?
      goto  $-1         ; nope, keep waiting
      goto  kount       ; yes, update display


cont_dn:                ;Decrease contrast command from user
      movlw 0x1         ;
      subwf contrastH,f ;

      movf  c_lim_bot,w ;check for limit stop
      subwf contrastH,w ;
      btfsc STATUS,Z    ; if contrastH = c_lim_bot
      goto  cont_up           ;   then kick it up one notch

      btfss tick_flag,0 ;debounce; has one count ticked off yet?
      goto  $-1         ; nope, keep waiting
      goto  kount       ; yes, update display


kount:      clrf  tick_flag   ;Increment display counter, clear flag
first

;***  RTC new digits: Count as a three digit BCD number

                  ;DIGIT 0
                  ;
      incf  digit+0,f   ;increment digit 0
      movlw 0xa         ; is the value greater than 9?
      subwf digit+0,w   ;  (subtract 10, test for NO borrow)
      btfss STATUS,C    ;
      goto  muxmap            ;  borrow didn't occur
      clrf  digit+0           ;  borrow occured (correct the digit)

                  ;DIGIT 1
```

```
                        ;
      incf  digit+1,f   ;increment digit 1
      movlw 0xa         ; is the value greater than 9?
      subwf digit+1,w   ;  (subtract 10, test for NO borrow)
      btfss STATUS,C    ;
      goto  muxmap            ;  borrow didn't occur
      clrf  digit+1           ;  borrow occured (correct the digit)

                ;DIGIT 2
                        ;
      incf  digit+2,f   ;increment digit 2
      movlw 0xa         ; is the value greater than 9?
      subwf digit+2,w   ;  (subtract 10, test for NO borrow)
      btfss STATUS,C    ;
      goto  muxmap            ;  borrow didn't occur
      clrf  digit+2           ;  borrow occured (correct the digit)


;***  Multiplex digits into PORTB & PORTC LCD holding registers
;                                 (and their inverts)

muxmap:
      pagesel     mapper            ;set paging registers
      call  mapper            ;map digits to LCD holding registers
      pagesel main            ;realign page register

      goto  main        ;loop back and wait for next tick


;*********************************************************************
;*********************************************************************
;
;                 L C D   M A P P I N G   T A B L E S
;
;
;     Note: These tables are designed to work with a particular LCD.
;           The user needs to REDO ALL OF THE BINARY TABLES for the
;           LCD in his application.
;
;*********************************************************************
      org   0x800 ;put all the table lookups on one mem page
;*********************************************************************
;
;  SEGMENT MAPS - Asserted output pins for making 7 segment digits
;
;     LCD to PIC Wiring:
;     ------------------------------------
;     LCD#  PIC    Com0  Com1  Com2
;     ----- ----- ----- ----- -----
;     1     A2,A3       COM1
;     2     B4    2F    2E    'C'
;     3     B5    1B    1C    'S'
;     4     B0    1A    1G    1D
;     5     B2    1F    1E    S1
;     6     A0,A1 COM0
;     7
;     8     B1    S3    3C    3D
;     9     C5    S4    3A    3B
;     10    C4    2B    2C    S2
```

ATTORNEY DOCKET NO. 068354.1121/MTI-1823

```
;       11      C3      2A      2G      2D
;       12      A4,A5                   COM2
;
;*********************************************************************
;
;       Map digits onto port registers and their inverts
;
mapper:

        ;*** COMMON 0 sequence

        movf  digit+0,w    ;assert the segments on PORTB
        call  dig0_PB_com0       ; corresponding to digit 0
        movwf seg_PB+0           ; save in PORTB holding register

        movf  digit+1,w    ;assert the segments on PORTB
        call  dig1_PB_com0       ; corresponding to digit 1
        iorwf seg_PB+0,f   ; save in PORTB holding register

        pagesel     dig2_PB_com0       ;prepare for call
        movf  digit+2,w    ;assert the segments on PORTB
        call  dig2_PB_com0       ; corresponding to digit 2
        iorwf seg_PB+0,f   ; save in PORTB holding register
        pagesel     mapper             ;point back to this page

        movlw 0xff         ;invert contents of holding reg
        xorwf seg_PB+0,f   ; save in the non-inverted data
        xorwf seg_PB+0,w   ; in the i holding register
        movwf iseg_PB+0    ;


        movf  digit+0,w    ;assert the segments on PORTC
        call  dig0_PC_com0       ; corresponding to digit 0
        movwf seg_PC+0           ; save in PORTC holding register

        movf  digit+1,w    ;assert the segments on PORTC
        call  dig1_PC_com0       ; corresponding to digit 1
        iorwf seg_PC+0,f   ; save in PORTC holding register

        pagesel     dig2_PC_com0       ;prepare for call
        movf  digit+2,w    ;assert the segments on PORTC
        call  dig2_PC_com0       ; corresponding to digit 2
        iorwf seg_PC+0,f   ; save in PORTC holding register
        pagesel     mapper             ;point back to this page

        movlw 0xff         ;invert contents of holding reg
        xorwf seg_PC+0,f   ; save in the non-inverted data
        xorwf seg_PC+0,w   ; in the i holding register
        movwf iseg_PC+0    ;


        ;*** COMMON 1 sequence

        movf  digit+0,w    ;assert the segments on PORTB
        call  dig0_PB_com1       ; corresponding to digit 0
        movwf seg_PB+1           ; save in PORTB holding register

        movf  digit+1,w    ;assert the segments on PORTB
        call  dig1_PB_com1       ; corresponding to digit 1
        iorwf seg_PB+1,f   ; save in PORTB holding register
```

ATTORNEY DOCKET NO. 068354.1121/MTI-1823

```
pagesel     dig2_PB_com1       ;prepare for call
movf  digit+2,w    ;assert the segments on PORTB
call  dig2_PB_com1       ; corresponding to digit 2
iorwf seg_PB+1,f  ; save in PORTB holding register
pagesel     mapper             ;point back to this page

movlw 0xff         ;invert contents of holding reg
xorwf seg_PB+1,f  ; save in the non-inverted data
xorwf seg_PB+1,w  ; in the i holding register
movwf iseg_PB+1   ;


movf  digit+0,w    ;assert the segments on PORTC
call  dig0_PC_com1       ; corresponding to digit 0
movwf seg_PC+1           ; save in PORTC holding register

movf  digit+1,w    ;assert the segments on PORTC
call  dig1_PC_com1       ; corresponding to digit 1
iorwf seg_PC+1,f  ; save in PORTC holding register

pagesel     dig2_PC_com1       ;prepare for call
movf  digit+2,w    ;assert the segments on PORTC
call  dig2_PC_com1       ; corresponding to digit 2
iorwf seg_PC+1,f  ; save in PORTC holding register
pagesel     mapper             ;point back to this page

movlw 0xff         ;invert contents of holding reg
xorwf seg_PC+1,f  ; save in the non-inverted data
xorwf seg_PC+1,w  ; in the i holding register
movwf iseg_PC+1   ;


;*** COMMON 2 sequence

movf  digit+0,w    ;assert the segments on PORTB
call  dig0_PB_com2       ; corresponding to digit 0
movwf seg_PB+2           ; save in PORTB holding register

movf  digit+1,w    ;assert the segments on PORTB
call  dig1_PB_com2       ; corresponding to digit 1
iorwf seg_PB+2,f  ; save in PORTB holding register

pagesel     dig2_PB_com2       ;prepare for call
movf  digit+2,w    ;assert the segments on PORTB
call  dig2_PB_com2       ; corresponding to digit 2
iorwf seg_PB+2,f  ; save in PORTB holding register
pagesel     mapper             ;point back to this page

movlw 0xff         ;invert contents of holding reg
xorwf seg_PB+2,f  ; save in the non-inverted data
xorwf seg_PB+2,w  ; in the i holding register
movwf iseg_PB+2   ;


movf  digit+0,w    ;assert the segments on PORTC
call  dig0_PC_com2       ; corresponding to digit 0
movwf seg_PC+2           ; save in PORTC holding register

movf  digit+1,w    ;assert the segments on PORTC
call  dig1_PC_com2       ; corresponding to digit 1
iorwf seg_PC+2,f  ; save in PORTC holding register
```

ATTORNEY DOCKET NO. 068354.1121/MTI-1823

```
      pagesel     dig2_PC_com2       ;prepare for call
      movf  digit+2,w    ;assert the segments on PORTC
      call  dig2_PC_com2       ; corresponding to digit 2
      iorwf seg_PC+2,f   ; save in PORTC holding register
      pagesel     mapper             ;point back to this page

      movlw 0xff         ;invert contents of holding reg
      xorwf seg_PC+2,f   ; save in the non-inverted data
      xorwf seg_PC+2,w   ; in the i holding register
      movwf iseg_PC+2    ;

      bcf   seg_PC+0,2
      bcf   seg_PC+1,2
      bcf   seg_PC+2,2
      bcf   iseg_PC+0,2
      bcf   iseg_PC+1,2
      bcf   iseg_PC+2,2

      retlw 0x0          ;end of mapper routine

;*********************************************************************
;
;                  DRIVING DIGIT 0
;      ----------------------------------------
;         Common0      Common1      Common2
;      -------------   --------------   -------------
;Char PORTB PORTC PORTB PORTC PORTB PORTC
;---- ----- ----- ----- ----- ----- -----
;0    B4    C4,C3 B4    C4          C3
;1          C4          C4
;2          C4,C3 B4    C3          C3
;3          C4,C3       C4,C3       C3
;4    B4    C4          C4,C3
;5    B4    C3          C4,C3       C3
;6    B4    C3    B4    C4,C3       C3
;7          C4,C3       C4
;8    B4    C4,C3 B4    C4,C3       C3
;9    B4    C4,C3       C4,C3       C3
;
;
dig0_PB_com0:
      addwf PCL,f        ;add w to prog counter (index of table)
      retlw b'00010000'  ; segment coding for BCD=0
      retlw b'00000000'  ; segment coding for BCD=1
      retlw b'00000000'  ; segment coding for BCD=2
      retlw b'00000000'  ; segment coding for BCD=3
      retlw b'00010000'  ; segment coding for BCD=4
      retlw b'00010000'  ; segment coding for BCD=5
      retlw b'00010000'  ; segment coding for BCD=6
      retlw b'00000000'  ; segment coding for BCD=7
      retlw b'00010000'  ; segment coding for BCD=8
      retlw b'00010000'  ; segment coding for BCD=9
;
dig0_PC_com0:
      addwf PCL,f        ;add w to prog counter (index of table)
      retlw b'00011000'  ; segment coding for BCD=0
      retlw b'00010000'  ; segment coding for BCD=1
      retlw b'00011000'  ; segment coding for BCD=2
      retlw b'00011000'  ; segment coding for BCD=3
```

ATTORNEY DOCKET NO. 068354.1121/MTI-1823

```
        retlw b'00010000'  ; segment coding for BCD=4
        retlw b'00001000'  ; segment coding for BCD=5
        retlw b'00001000'  ; segment coding for BCD=6
        retlw b'00011000'  ; segment coding for BCD=7
        retlw b'00011000'  ; segment coding for BCD=8
        retlw b'00011000'  ; segment coding for BCD=9
;
dig0_PB_com1:
        addwf PCL,f        ;add w to prog counter (index of table)
        retlw b'00010000'  ; segment coding for BCD=0
        retlw b'00000000'  ; segment coding for BCD=1
        retlw b'00010000'  ; segment coding for BCD=2
        retlw b'00000000'  ; segment coding for BCD=3
        retlw b'00000000'  ; segment coding for BCD=4
        retlw b'00000000'  ; segment coding for BCD=5
        retlw b'00010000'  ; segment coding for BCD=6
        retlw b'00000000'  ; segment coding for BCD=7
        retlw b'00010000'  ; segment coding for BCD=8
        retlw b'00000000'  ; segment coding for BCD=9
;
dig0_PC_com1:
        addwf PCL,f        ;add w to prog counter (index of table)
        retlw b'00010000'  ; segment coding for BCD=0
        retlw b'00010000'  ; segment coding for BCD=1
        retlw b'00001000'  ; segment coding for BCD=2
        retlw b'00011000'  ; segment coding for BCD=3
        retlw b'00011000'  ; segment coding for BCD=4
        retlw b'00011000'  ; segment coding for BCD=5
        retlw b'00011000'  ; segment coding for BCD=6
        retlw b'00010000'  ; segment coding for BCD=7
        retlw b'00011000'  ; segment coding for BCD=8
        retlw b'00011000'  ; segment coding for BCD=9
;
dig0_PB_com2:
        addwf PCL,f        ;add w to prog counter (index of table)
        retlw b'00000000'  ; segment coding for BCD=0
        retlw b'00000000'  ; segment coding for BCD=1
        retlw b'00000000'  ; segment coding for BCD=2
        retlw b'00000000'  ; segment coding for BCD=3
        retlw b'00000000'  ; segment coding for BCD=4
        retlw b'00000000'  ; segment coding for BCD=5
        retlw b'00000000'  ; segment coding for BCD=6
        retlw b'00000000'  ; segment coding for BCD=7
        retlw b'00000000'  ; segment coding for BCD=8
        retlw b'00000000'  ; segment coding for BCD=9
;
dig0_PC_com2:
        addwf PCL,f        ;add w to prog counter (index of table)
        retlw b'00001000'  ; segment coding for BCD=0
        retlw b'00000000'  ; segment coding for BCD=1
        retlw b'00001000'  ; segment coding for BCD=2
        retlw b'00001000'  ; segment coding for BCD=3
        retlw b'00000000'  ; segment coding for BCD=4
        retlw b'00001000'  ; segment coding for BCD=5
        retlw b'00001000'  ; segment coding for BCD=6
        retlw b'00000000'  ; segment coding for BCD=7
        retlw b'00001000'  ; segment coding for BCD=8
        retlw b'00001000'  ; segment coding for BCD=9
;
```

ATTORNEY DOCKET NO. 068354.1121/MTI-1823

```
;*****************************************************************
;
;                    DRIVING DIGIT 1
;       ---------------------------------------------
;          Common0      Common1      Common2
;       -------------   --------------   -------------
;Char PORTB PORTC PORTB PORTC PORTB PORTC
;---- ----- ----- ----- ----- ----- -----
;0    B5,B2,B0    B5,B2       B0
;1    B5          B5
;2    B5,B0       B2,B0       B0
;3    B5,B0       B0          B0
;4    B5,B2       B5,B0
;5    B2,B0       B5,B0       B0
;6    B2,B0       B5,B2,B0    B0
;7    B5,B0       B5
;8    B5,B2,B0    B5,B2,B0    B0
;9    B5,B2,B0    B5,B0       B0
;
dig1_PB_com0:
      addwf PCL,f        ;add w to prog counter (index of table)
      retlw b'00100101'  ; segment coding for BCD=0
      retlw b'00100000'  ; segment coding for BCD=1
      retlw b'00100001'  ; segment coding for BCD=2
      retlw b'00100001'  ; segment coding for BCD=3
      retlw b'00100100'  ; segment coding for BCD=4
      retlw b'00000101'  ; segment coding for BCD=5
      retlw b'00000101'  ; segment coding for BCD=6
      retlw b'00100001'  ; segment coding for BCD=7
      retlw b'00100101'  ; segment coding for BCD=8
      retlw b'00100101'  ; segment coding for BCD=9
;
dig1_PC_com0:
      addwf PCL,f        ;add w to prog counter (index of table)
      retlw b'00000000'  ; segment coding for BCD=0
      retlw b'00000000'  ; segment coding for BCD=1
      retlw b'00000000'  ; segment coding for BCD=2
      retlw b'00000000'  ; segment coding for BCD=3
      retlw b'00000000'  ; segment coding for BCD=4
      retlw b'00000000'  ; segment coding for BCD=5
      retlw b'00000000'  ; segment coding for BCD=6
      retlw b'00000000'  ; segment coding for BCD=7
      retlw b'00000000'  ; segment coding for BCD=8
      retlw b'00000000'  ; segment coding for BCD=9
;
dig1_PB_com1:
      addwf PCL,f        ;add w to prog counter (index of table)
      retlw b'00100100'  ; segment coding for BCD=0
      retlw b'00100000'  ; segment coding for BCD=1
      retlw b'00000101'  ; segment coding for BCD=2
      retlw b'00100001'  ; segment coding for BCD=3
      retlw b'00100001'  ; segment coding for BCD=4
      retlw b'00100001'  ; segment coding for BCD=5
      retlw b'00100101'  ; segment coding for BCD=6
      retlw b'00100000'  ; segment coding for BCD=7
      retlw b'00100101'  ; segment coding for BCD=8
      retlw b'00100001'  ; segment coding for BCD=9
;
dig1_PC_com1:
      addwf PCL,f        ;add w to prog counter (index of table)
      retlw b'00000000'  ; segment coding for BCD=0
```

ATTORNEY DOCKET NO. 068354.1121/MTI-1823

```
        retlw b'00000000'  ; segment coding for BCD=1
        retlw b'00000000'  ; segment coding for BCD=2
        retlw b'00000000'  ; segment coding for BCD=3
        retlw b'00000000'  ; segment coding for BCD=4
        retlw b'00000000'  ; segment coding for BCD=5
        retlw b'00000000'  ; segment coding for BCD=6
        retlw b'00000000'  ; segment coding for BCD=7
        retlw b'00000000'  ; segment coding for BCD=8
        retlw b'00000000'  ; segment coding for BCD=9
;
dig1_PB_com2:
        addwf PCL,f        ;add w to prog counter (index of table)
        retlw b'00000001'  ; segment coding for BCD=0
        retlw b'00000000'  ; segment coding for BCD=1
        retlw b'00000001'  ; segment coding for BCD=2
        retlw b'00000001'  ; segment coding for BCD=3
        retlw b'00000000'  ; segment coding for BCD=4
        retlw b'00000001'  ; segment coding for BCD=5
        retlw b'00000001'  ; segment coding for BCD=6
        retlw b'00000000'  ; segment coding for BCD=7
        retlw b'00000001'  ; segment coding for BCD=8
        retlw b'00000001'  ; segment coding for BCD=9
;
dig1_PC_com2:
        addwf PCL,f        ;add w to prog counter (index of table)
        retlw b'00000000'  ; segment coding for BCD=0
        retlw b'00000000'  ; segment coding for BCD=1
        retlw b'00000000'  ; segment coding for BCD=2
        retlw b'00000000'  ; segment coding for BCD=3
        retlw b'00000000'  ; segment coding for BCD=4
        retlw b'00000000'  ; segment coding for BCD=5
        retlw b'00000000'  ; segment coding for BCD=6
        retlw b'00000000'  ; segment coding for BCD=7
        retlw b'00000000'  ; segment coding for BCD=8
        retlw b'00000000'  ; segment coding for BCD=9
;
```

```
;*****************************************************************
;
;                    DRIVING DIGIT 2
;        ----------------------------------------
;           Common0      Common1      Common2
;        -------------   -------------   -------------
;Char PORTB PORTC PORTB PORTC PORTB PORTC
;---- ----- ----- ----- ----- ----- -----
;0
;1                                B2
;2                B1     C5       B1
;3                       C5       B1     C5
;4                                B4
;5                                B5
;6          C5
;7    B1
;8                                       C4
;9    B1    C5     B1     C5       B5,B4,       C5,C4
;                                 B1,B2
```

ATTORNEY DOCKET NO. 068354.1121/MTI-1823

```
      org   0x1000        ;don't allow table to cross a page boundry

dig2_PB_com0:
      addwf PCL,f         ;add w to prog counter (index of table)
      retlw b'00000000'   ; segment coding for BCD=0
      retlw b'00000000'   ; segment coding for BCD=1
      retlw b'00000000'   ; segment coding for BCD=2
      retlw b'00000000'   ; segment coding for BCD=3
      retlw b'00000000'   ; segment coding for BCD=4
      retlw b'00000000'   ; segment coding for BCD=5
      retlw b'00000000'   ; segment coding for BCD=6
      retlw b'00000001'   ; segment coding for BCD=7
      retlw b'00000000'   ; segment coding for BCD=8
      retlw b'00000001'   ; segment coding for BCD=9
;
dig2_PC_com0:
      addwf PCL,f         ;add w to prog counter (index of table)
      retlw b'00000000'   ; segment coding for BCD=0
      retlw b'00000000'   ; segment coding for BCD=1
      retlw b'00000000'   ; segment coding for BCD=2
      retlw b'00000000'   ; segment coding for BCD=3
      retlw b'00000000'   ; segment coding for BCD=4
      retlw b'00000000'   ; segment coding for BCD=5
      retlw b'00100000'   ; segment coding for BCD=6
      retlw b'00000000'   ; segment coding for BCD=7
      retlw b'00000000'   ; segment coding for BCD=8
      retlw b'00100000'   ; segment coding for BCD=9
;
dig2_PB_com1:
      addwf PCL,f         ;add w to prog counter (index of table)
      retlw b'00000000'   ; segment coding for BCD=0
      retlw b'00000000'   ; segment coding for BCD=1
      retlw b'00000010'   ; segment coding for BCD=2
      retlw b'00000000'   ; segment coding for BCD=3
      retlw b'00000000'   ; segment coding for BCD=4
      retlw b'00000000'   ; segment coding for BCD=5
      retlw b'00000000'   ; segment coding for BCD=6
      retlw b'00000000'   ; segment coding for BCD=7
      retlw b'00000000'   ; segment coding for BCD=8
      retlw b'00000010'   ; segment coding for BCD=9
;
dig2_PC_com1:
      addwf PCL,f         ;add w to prog counter (index of table)
      retlw b'00000000'   ; segment coding for BCD=0
      retlw b'00000000'   ; segment coding for BCD=1
      retlw b'00100000'   ; segment coding for BCD=2
      retlw b'00100000'   ; segment coding for BCD=3
      retlw b'00000000'   ; segment coding for BCD=4
      retlw b'00000000'   ; segment coding for BCD=5
      retlw b'00000000'   ; segment coding for BCD=6
      retlw b'00000000'   ; segment coding for BCD=7
      retlw b'00000000'   ; segment coding for BCD=8
      retlw b'00100000'   ; segment coding for BCD=9
;
dig2_PB_com2:
      addwf PCL,f         ;add w to prog counter (index of table)
      retlw b'00000000'   ; segment coding for BCD=0
      retlw b'00000100'   ; segment coding for BCD=1
      retlw b'00000010'   ; segment coding for BCD=2
      retlw b'00000010'   ; segment coding for BCD=3
      retlw b'00010000'   ; segment coding for BCD=4
```

ATTORNEY DOCKET NO. 068354.1121/MTI-1823

```
        retlw b'00100000'  ; segment coding for BCD=5
        retlw b'00000000'  ; segment coding for BCD=6
        retlw b'00000000'  ; segment coding for BCD=7
        retlw b'00000000'  ; segment coding for BCD=8
        retlw b'00110110'  ; segment coding for BCD=9
;
dig2_PC_com2:
        addwf PCL,f        ;add w to prog counter (index of table)
        retlw b'00000000'  ; segment coding for BCD=0
        retlw b'00000000'  ; segment coding for BCD=1
        retlw b'00000000'  ; segment coding for BCD=2
        retlw b'00100000'  ; segment coding for BCD=3
        retlw b'00000000'  ; segment coding for BCD=4
        retlw b'00000000'  ; segment coding for BCD=5
        retlw b'00000000'  ; segment coding for BCD=6
        retlw b'00000000'  ; segment coding for BCD=7
        retlw b'00010000'  ; segment coding for BCD=8
        retlw b'00110000'  ; segment coding for BCD=9


;*********************************************************************
;*********************************************************************

        END          ;directive 'end of program'
```

What is claimed is:

1. A method of driving a liquid crystal display (LCD) having a backplane and a plurality of segments, said method comprising the steps of:

applying a high logic voltage level to a backplane, a low logic voltage level to asserted ones of a plurality of segments, and the high logic voltage level to deasserted ones of the plurality of segments for a first time period;

applying the high logic voltage level to the backplane, the low logic voltage level to the asserted ones of the plurality of segments, and the high logic voltage level to the deasserted ones of the plurality of segments for the first time period;

applying the high logic voltage level to the backplane, the low logic voltage level to the asserted ones of the plurality of segments, and the low logic voltage level to the deasserted ones of the plurality of segments for the first time period;

applying the low logic voltage level to the backplane, the low logic voltage level to the asserted ones of the plurality of segments, and the low logic voltage level to the deasserted ones of the plurality of segments for a second time period;

applying the low logic voltage level to the backplane, the high logic voltage level to the asserted ones of the plurality of segments, and the low logic voltage level to the deasserted ones of the plurality of segments for the first time period;

applying the low logic voltage level to the backplane, the high logic voltage level to the asserted ones of the plurality of segments, and the low logic voltage level to the deasserted ones of the plurality of segments for the first time period;

applying the low logic voltage level to the backplane, the high logic voltage level to the asserted ones of the plurality of segments, and the high logic voltage level to the deasserted ones of the plurality of segments for the first time period; and applying the high logic voltage level to the backplane, the high logic voltage level to the asserted ones of the plurality of segments, and the high logic voltage level to the deasserted ones of the plurality of segments for the second time period.

2. A method of driving a liquid crystal display (LCD) having N backplanes and a plurality of segments, said method comprising the steps of:

a) applying a high logic voltage level to an asserted backplane i of N backplanes, the high logic voltage level to deasserted backplanes of the N backplanes, the low logic voltage level to asserted ones of a plurality of segments, and the high logic voltage level to deasserted ones of the plurality of segments for a first time period;

b) applying the high logic voltage level to the asserted backplane i of the N backplanes, the low logic voltage level to the deasserted backplanes of the N backplanes, the low logic voltage level to the asserted ones of the plurality of segments, and the high logic voltage level to the deasserted ones of the plurality of segments for the first time period;

c) applying the high logic voltage level to the asserted backplane i of the N backplanes, the low logic voltage level to the deasserted backplanes of the N backplanes, the low logic voltage level to the asserted ones of the plurality of segments, and the low logic voltage level to the deasserted ones of the plurality of segments for the first time period;

d) applying the low logic voltage level to the asserted backplane i of the N backplanes, the low logic voltage level to the deasserted backplanes of the N backplanes, the low logic voltage level to the asserted ones of the plurality of segments, and the low logic voltage level to the deasserted ones of the plurality of segments for a second time period;

e) applying the low logic voltage level to the asserted backplane i of the N backplanes, the low logic voltage level to the deasserted backplanes of the N backplanes, the high logic voltage level to the asserted ones of the plurality of segments, and the low logic voltage level to the deasserted ones of the plurality of segments for the first time period;

f) applying the low logic voltage level to the asserted backplane i of the N backplanes, the high logic voltage level to the deasserted backplanes of the N backplanes, the high logic voltage level to the asserted ones of the plurality of segments, and the low logic voltage level to the deasserted ones of the plurality of segments for the first time period;

g) applying the low logic voltage level to the asserted backplane i of the N backplanes, the high logic voltage level to the deasserted backplanes of the N backplanes, the high logic voltage level to the asserted ones of the plurality of segments, and the high logic voltage level to the deasserted ones of the plurality of segments for the first time period;

h) applying the high logic voltage level to the asserted backplane i of the N backplanes, the high logic voltage level to the deasserted backplanes of the N backplanes, the high logic voltage level to the asserted ones of the plurality of segments, and the high logic voltage level to the deasserted ones of the plurality of LCD segments for the second time period; and i) incrementing i by 1 then repeating steps a) through h) until i N.

3. A method of driving a liquid crystal display (LCD) having N backplanes and a plurality of segments, said method comprising the steps of:

a) applying a low logic voltage level to an asserted backplane i of N backplanes, the low logic voltage level to deasserted backplanes of the N backplanes, the low logic voltage level to asserted ones of a plurality of segments, and a high logic voltage level to deasserted ones of the plurality of segments for a first time period;

b) applying the low logic voltage level to the asserted backplane i of the N backplanes, the high logic voltage level to the deasserted backplanes of the N backplanes, the low logic voltage level to the asserted ones of the plurality of segments, and the high logic voltage level to the deasserted ones of the plurality of segments for the first time period;

c) applying the low logic voltage level to the asserted backplane i of the N backplanes, the high logic voltage level to the deasserted backplanes of the N backplanes, the low logic voltage level to the asserted ones of the plurality of segments, and the low logic voltage level to the deasserted ones of the plurality of segments for the first time period;

d) applying the low logic voltage level to the asserted backplane i of the N backplanes, the low logic voltage level to the deasserted backplanes of the N backplanes, the low logic voltage level to the asserted ones of the plurality of segments, and the low logic voltage level to the deasserted ones of the plurality of segments for a second time period;

e) applying the high logic voltage level to the asserted backplane i of the N backplanes, the high logic voltage level to the deasserted backplanes of the N backplanes, the high logic voltage level to the asserted ones of the plurality of segments, and the low logic voltage level to the deasserted ones of the plurality of segments for the first time period;

f) applying the high logic voltage level to the asserted backplane i of the N backplanes, the low logic voltage level to the deasserted backplanes of the N backplanes, the high logic voltage level to the asserted ones of the plurality of segments, and the low logic voltage level to the deasserted ones of the plurality of segments for the first time period;

g) applying the high logic voltage level to the asserted backplane i of the N backplanes, the low logic voltage level to the deasserted backplanes of the N backplanes, the high logic voltage level to the asserted ones of the plurality of segments, and the high logic voltage level to the deasserted ones of the plurality of segments for the first time period;

h) applying the high logic voltage level to the asserted backplane i of the N backplanes, the high logic voltage level to the deasserted backplanes of the N backplanes, the high logic voltage level to the asserted ones of the plurality of segments, and the high logic voltage level to the deasserted ones of the plurality of LCD segments for the second time period; and i) incrementing i by 1 then repeating steps a) through h) until i=N.

4. A method of driving a liquid crystal display (LCD) having N backplanes and a plurality of segments, said method comprising the steps of:

a) applying a high logic voltage level to an asserted backplane i of N backplanes, the high logic voltage level to deasserted backplanes of the N backplanes, a low logic voltage level to asserted ones of a plurality of segments, and the high logic voltage level to deasserted ones of the plurality of segments for a first time period;

b) applying the high logic voltage level to the asserted backplane i of the N backplanes, the low logic voltage level to the deasserted backplanes of the N backplanes, the low logic voltage level to the asserted ones of the plurality of segments, and the high logic voltage level to the deasserted ones of the plurality of segments for the first time period;

c) applying the low logic voltage level to the asserted backplane i of the N backplanes, the low logic voltage level to the deasserted backplanes of the N backplanes, the low logic voltage level to the asserted ones of the plurality of segments, and the low logic voltage level to the deasserted ones of the plurality of segments for a second time period;

d) applying the low logic voltage level to the asserted backplane i of the N backplanes, the low logic voltage level to the deasserted backplanes of the N backplanes, the high logic voltage level to the asserted ones of the plurality of segments, and the low logic voltage level to the deasserted ones of the plurality of segments for the first time period;

e) applying the low logic voltage level to the asserted backplane i of the N backplanes, the high logic voltage level to the deasserted backplanes of the N backplanes, the high logic voltage level to the asserted ones of the plurality of segments, and the low logic voltage level to the deasserted ones of the plurality of segments for the first time period;

f) applying the high logic voltage level to the asserted backplane i of the N backplanes, the high logic voltage level to the deasserted backplanes of the N backplanes, the high logic voltage level to the asserted ones of the plurality of segments, and the high logic voltage level to the deasserted ones of the plurality of segments for the first time period; and g) incrementing i by 1 then repeating steps a) through f) until i=N.

5. A method of driving a liquid crystal display (LCD) having N backplanes and a plurality of segments, said method comprising the steps of:

a) applying a low logic voltage level to an asserted backplane i of N backplanes, a high logic voltage level to deasserted backplanes of the N backplanes, the low logic voltage level to asserted ones of a plurality of segments, and the high logic voltage level to deasserted ones of the plurality of segments for a first time period;

b) applying the low logic voltage level to the asserted backplane i of the N backplanes, the low logic voltage level to the deasserted backplanes of the N backplanes, the low logic voltage level to the asserted ones of the plurality of segments, and the high logic voltage level to the deasserted ones of the plurality of segments for the first time period;

c) applying the low logic voltage level to the asserted backplane i of the N backplanes, the low logic voltage level to the deasserted backplanes of the N backplanes, the low logic voltage level to the asserted ones of the plurality of segments, and the low logic voltage level to the deasserted ones of the plurality of segments for a second time period;

d) applying the high logic voltage level to the asserted backplane i of the N backplanes, the low logic voltage level to the deasserted backplanes of the N backplanes, the high logic voltage level to the asserted ones of the plurality of segments, and the low logic voltage level to the deasserted ones of the plurality of segments for the first time period;

e) applying the high logic voltage level to the asserted backplane i of the N backplanes, the high logic voltage level to the deasserted backplanes of the N backplanes, the high logic voltage level to the asserted ones of the plurality of segments, and the low logic voltage level to the deasserted ones of the plurality of segments for the first time period;

applying the high logic voltage level to the asserted backplane i of the N backplanes, the high logic voltage level to the deasserted backplanes of the N backplanes, the high logic voltage level to the asserted ones of the plurality of segments, and the high logic voltage level to the deasserted ones of the plurality of segments for the first time period; and g) incrementing i by 1 then repeating steps a) through f) until i=N.

6. An apparatus for performing the methods according to claims 1, 2, 3, 4 or 5, said apparatus comprising:

a liquid crystal display (LCD) having N backplanes and a plurality of segments; and a digital logic circuit having digital outputs connected to the N backplanes and the plurality of segments, wherein the digital outputs are adapted for applying high and low logic voltage levels thereto.

7. The apparatus according to claim 6, wherein N is a positive integer number.

8. The apparatus according to claim 6, wherein said digital logic circuit and LCD are adapted to be powered from a battery power supply.

9. The apparatus according to claim 5, wherein LCD driving voltages are logic voltage level pulses from said digital logic circuit having voltage amplitudes substantially the same as a supply voltage of said digital logic circuit.

10. The apparatus according to claim 6, further comprising a temperature sensor coupled to said digital logic circuit, wherein the temperature sensor supplies ambient temperature information to said digital logic circuit so that said LCD operating parameters may be adjusted for changes in the ambient temperature.

11. The apparatus according to claim 6, wherein said digital logic circuit is a microcontroller.

12. The apparatus according to claim 6, wherein said digital logic circuit is a microcomputer.

13. The apparatus according to claim 6, wherein said digital logic circuit is a programmable logic array.

14. The apparatus according to claim 6, wherein said digital logic circuit is a application specific integrated circuit.

15. The apparatus according to claim 6, wherein said digital logic circuit is controlled by a software program.

16. The apparatus according to claim 15, wherein the software program is stored in non-volatile memory.

17. The apparatus according to claim 16, wherein the non-volatile memory is read only memory (ROM).

18. The apparatus according to claim 16, wherein the non-volatile memory is electrically erasable and programmable read only memory (EEPROM).

19. The apparatus according to claim 6, wherein said digital logic circuit is controlled by firmware.

20. The apparatus according to claim 6, wherein said LCD displays a function performed by said digital logic circuit.

21. The apparatus according to claim 20, wherein the function performed by said digital logic circuit is selected from the group consisting of control of temperature (thermostat), humidity, sprinkler, alarm and security system, alarm clock, timer, clothes dryer, washing machine, toaster, microwave, overt, cooktop, clothes iron, water heater, tankless water heater, solar heating, swimming pool, jacuzzi, answering machine, pager, telephone, intercom, caller identification, electronic address book, treadmill, stationary bicycle, exercise machine, torque wrench, depth gauge, scale, speedometer, automobile tire condition status, anti-skid and anti-lock brakes, fuel gauge, engine monitoring, operation of luminaries (lights) in a building, power load management, video cassette player, DVD player, uninterruptable power supply (UPS), dictaphone, tape recorder, MP3 music player, video game toy, calculator and personal digital organizer.

22. A method of driving a liquid crystal display (LCD) having a backplane and a plurality of segments, said method comprising the steps of:

a) during a first phase having a first time period,
applying a high logic voltage level to a backplane,
applying a low logic voltage level to asserted ones of a plurality of segments, and
applying the high logic voltage level to deasserted ones of the plurality of segments;

b) during a second phase having the first time period,
applying the high logic voltage level to the backplane,
applying the low logic voltage level to the asserted ones of the plurality of segments, and
plurality of segments;

c) during a third phase having the first time period,
applying the high logic voltage level to the backplane,
applying the low logic voltage level to the asserted ones of the plurality of segments, and
applying the low logic voltage level to the deasserted ones of the plurality of segments;

d) during a fourth phase having a second time period,
applying the low logic voltage level to the backplane,
applying the low logic voltage level to the asserted ones of the plurality of segments, and
applying the low logic voltage level to the deasserted ones of the plurality of segments;

e) during a fifth phase having the first time period,
applying the low logic voltage level to the backplane,
applying the high logic voltage level to the asserted ones of the plurality of segments, and
applying the low logic voltage level to the deasserted ones of the plurality of segments;

f) during a sixth phase having the first time period,
applying the low logic voltage level to the backplane,
applying the high logic voltage level to the asserted ones of the plurality of segments, and
applying the low logic voltage level to the deasserted ones of the plurality of segments;

g) during a seventh phase having the first time period,
applying the low logic voltage level to the backplane,
applying the high logic voltage level to the asserted ones of the plurality of segments, and
applying the high logic voltage level to the deasserted ones of the plurality of segments; and during an eighth phase having the second time period,
applying the high logic voltage level to the backplane,
applying the high logic voltage level to the asserted ones of the plurality of segments, and
applying the high logic voltage level to the deasserted ones of the plurality of segments.

23. The method of claim 22, further comprising the step of adjusting contrast of the plurality of segments by varying the second time period in relation to the first time period.

24. The method of claim 22, wherein the second time period is equal to the first time period times a constant, C.

25. A method of driving a liquid crystal display (LCD) having N backplanes and a plurality of segments, said method comprising the steps of:

a) during a first phase having a first time period,
applying a high logic voltage level to an asserted backplane i of N backplanes,
applying the high logic voltage level to deasserted backplanes of the N backplanes,
applying a low logic voltage level to asserted ones of a plurality of segments, and
applying the high logic voltage level to deasserted ones of the plurality of segments;

b) during a second phase having the first time period,
applying the high logic voltage level to the asserted backplane i of the N backplanes,
applying a low logic voltage level to the deasserted backplanes of the N backplanes,
applying the low logic voltage level to the asserted ones of the plurality of segments, and
applying the high logic voltage level to the deasserted ones of the plurality of segments;

c) during a third phase having the first time period,
applying the high logic voltage level to the asserted backplane i of the N backplanes, applying the low logic voltage level to the deasserted backplanes of the N backplanes, applying the low logic voltage level to the asserted ones of the plurality of segments, and applying the low logic voltage level to the deasserted ones of the plurality of segments;

d) during a fourth phase having a second time period, applying the low logic voltage level to the asserted backplane i of the N backplanes, applying the low logic voltage level to the deasserted backplanes of the N backplanes, applying the low logic voltage level to the asserted ones of the plurality of segments, and applying the low logic voltage level to the deasserted ones of the plurality of segments;

e) during a fifth phase having the first time period, applying the low logic voltage level to the asserted backplane i of the N backplanes, applying the low logic voltage level to the deasserted backplanes of the N backplanes, applying the high logic voltage level to the asserted ones of the plurality of segments, and applying the low logic voltage level to the deasserted ones of the plurality of segments;

f) during a sixth phase having the first time period, applying the low logic voltage level to the asserted backplane i of the N backplanes, applying the high logic voltage level to the deasserted backplanes of the N backplanes, applying the high logic voltage level to the asserted ones of the plurality of segments, and applying the low logic voltage level to the deasserted ones of the plurality of segments;

g) during a seventh phase having the first time period, applying the low logic voltage level to the asserted backplane i of the N backplanes, applying the high logic voltage level to the deasserted backplanes of the N backplanes, applying the high logic voltage level to the asserted ones of the plurality of segments, and applying the high logic voltage level to the deasserted ones of the plurality of segments;

h) during an eighth phase having the second time period, applying the high logic voltage level to the asserted backplane i of the N backplanes, applying the high logic voltage level to the deasserted backplanes of the N backplanes, applying the high logic voltage level to the asserted ones of the plurality of segments, applying the high logic voltage level to the deasserted ones of the plurality of LCD segments; and i) incrementing i by 1 then repeating steps a) through h) until i=N.

26. The method of claim 2, wherein the steps a) through h) are performed in an order that minimizes direct current (DC) voltage bias between the plurality of segments and N backplanes.

27. The method of claim 2, further comprising the step of adjusting contrast of the plurality of segments by varying the second time period in relation to the first time period.

28. The method of claim 2, further comprising the step of adjusting LCD biasing according to a temperature of said LCD.

29. A method of driving a liquid crystal display (LCD) having N backplanes and a plurality of segments, said method comprising the steps of:

a) during a first phase having a first time period, applying a low logic voltage level to an asserted backplane i of N backplanes, applying a low logic voltage level to deasserted backplanes of the N backplanes, applying the low logic voltage level to asserted ones of a plurality of segments, and applying the high logic voltage level to deasserted ones of the plurality of segments;

b) during a second phase having the first time period, applying the low logic voltage level to the asserted backplane i of the N backplanes, applying the high logic voltage level to the deasserted backplanes of the N backplanes, applying the low logic voltage level to the asserted ones of the plurality of segments, and applying the high logic voltage level to the deasserted ones of the plurality of segments;

c) during a third phase having the first time period, applying the low logic voltage level to the asserted backplane i of the N backplanes, applying the high logic voltage level to the deasserted backplanes of the N backplanes, applying the low logic voltage level to the asserted ones of the plurality of segments, and applying the low logic voltage level to the deasserted ones of the plurality of segments;

d) during a fourth phase having a second time period, applying the low logic voltage level to the asserted backplane i of the N backplanes, applying the low logic voltage level to the deasserted backplanes of the N backplanes, applying the low logic voltage level to the asserted ones of the plurality of segments, and applying the low logic voltage level to the deasserted ones of the plurality of segments;

e) during a fifth phase having the first time period, applying the high logic voltage level to the asserted backplane i of the N backplanes, applying the high logic voltage level to the deasserted backplanes of the N backplanes, applying the high logic voltage level to the asserted ones of the plurality of segments, and applying the low logic voltage level to the deasserted ones of the plurality of segments;

f) during a sixth phase having the first time period, applying the high logic voltage level to the asserted backplane i of the N backplanes, applying the low logic voltage level to the deasserted backplanes of the N backplanes, applying the high logic voltage level to the asserted ones of the plurality of segments, and applying the low logic voltage level to the deasserted ones of the plurality of segments;

g) during a seventh phase having the first time period, applying the high logic voltage level to the asserted backplane i of the N backplanes, applying the low logic voltage level to the deasserted backplanes of the N backplanes, applying the high logic voltage level to the asserted ones of the plurality of segments, and applying the high logic voltage level to the deasserted ones of the plurality of segments;

h) during an eighth phase having the second time period, applying the high logic voltage level to the asserted backplane i of the N backplanes, applying the high logic voltage level to the deasserted backplanes of the N backplanes, applying the high logic voltage level to the asserted ones of the plurality of segments, applying the high logic voltage level to the deasserted ones of the plurality of LCD segments; and i) incrementing i by 1 then repeating steps a) through h) until i=N.

30. The method of claim 3, wherein the steps a) through h) are performed in an order that minimizes direct current (DC) voltage bias between the plurality of segments and N backplanes.

31. The method of claim 3, further comprising the step of adjusting contrast of the plurality of segments by varying the second time period in relation to the first time period.

32. The method of claim 3, further comprising the step of adjusting LCD biasing according to a temperature of said LCD.

33. A method of driving a liquid crystal display (LCD) having N backplanes and a plurality of segments, said method comprising the steps of:

a) during a first phase having a first time period, applying a high logic voltage level to an asserted backplane i of N backplanes, applying the high logic voltage level to deasserted backplanes of the N backplanes, applying a low logic voltage level to asserted ones of a plurality of segments, and applying the high logic voltage level to deasserted ones of the plurality of segments;

b) during a second phase having the first time period, applying the high logic voltage level to the asserted backplane i of the N backplanes, applying the low logic voltage level to the deasserted backplanes of the N backplanes, applying the low logic voltage level to the asserted ones of the plurality of segments, and applying the high logic voltage level to the deasserted ones of the plurality of segments;

c) during a third phase having a second time period, applying the low logic voltage level to the asserted backplane i of the N backplanes, applying the low logic voltage level to the deasserted backplanes of the N backplanes, applying the low logic voltage level to the asserted ones of the plurality of segments, and applying the low logic voltage level to the deasserted ones of the plurality of segments;

d) during a fourth phase having the first time period, applying the low logic voltage level to the asserted backplane i of the N backplanes, applying the low logic voltage level to the deasserted backplanes of the N backplanes, applying the high logic voltage level to the asserted ones of the plurality of segments, and applying the low logic voltage level to the deasserted ones of the plurality of segments;

e) during a fifth phase having the first time period, applying the low logic voltage level to the asserted backplane i of the N backplanes, applying the high logic voltage level to the deasserted backplanes of the N backplanes, applying the high logic voltage level to the asserted ones of the plurality of segments, and applying the low logic voltage level to the deasserted ones of the plurality of segments;

f) during a sixth phase having the second time period, applying the high logic voltage level to the asserted backplane i of the N backplanes, applying the high logic voltage level to the deasserted backplanes of the N backplanes, applying the high logic voltage level to the asserted ones of the plurality of segments, and applying the high logic voltage level to the deasserted ones of the plurality of segments; and g) incrementing i by 1 then repeating steps a) through f) until i=N.

34. The method of claim 33, wherein the steps a) through h) are performed in an order that minimizes direct current (DC) voltage bias between the plurality of segments and N backplanes.

35. The method of claim 33, further comprising the step of adjusting further contrast of the plurality of segments by varying the second time period in relation to the first time period.

36. The method of claim 33, further comprising the step of adjusting LCD biasing according to a temperature of said LCD.

37. The method of claim 4, wherein the steps a) through h) are performed in an order that minimizes direct current (DC) voltage bias between the plurality of segments and N backplanes.

38. The method of claim 4, further comprising the step of adjusting contrast of the plurality of segments by varying the second time period in relation to the first time period.

39. The method of claim 4, further comprising the step of adjusting LCD biasing according to a temperature of said LCD.

40. A method of driving a liquid crystal display (LCD) having N backplanes and a plurality of segments, said method comprising the steps of:

a) during a first phase having a first time period, applying a low logic voltage level to an asserted backplane i of N backplanes, applying a high logic voltage level to deasserted backplanes of the N backplanes, applying the low logic voltage level to asserted ones of a plurality of segments, and applying the high logic voltage level to deasserted ones of the plurality of segments;

b) during a second phase having the first time period, applying the low logic voltage level to the asserted backplane i of the N backplanes, applying the low logic voltage level to the deasserted backplanes of the N backplanes, applying the low logic voltage level to the asserted ones of the plurality of segments, and applying the high logic voltage level to the deasserted ones of the plurality of segments;

c) during a third phase having a second time period, applying the low logic voltage level to the asserted backplane i of the N backplanes, applying the low logic voltage level to the deasserted backplanes of the N backplanes, applying the low logic voltage level to the asserted ones of the plurality of segments, and applying the low logic voltage level to the deasserted ones of the plurality of segments;

d) during a fourth phase having the first time period, applying the high logic voltage level to the asserted backplane i of the N backplanes, applying the low logic voltage level to the deasserted backplanes of the N backplanes, applying the high logic voltage level to the asserted ones of the plurality of segments, and applying the low logic voltage level to the deasserted ones of the plurality of segments;

e) during a fifth phase having the first time period, applying the high logic voltage level to the asserted backplane i of the N backplanes, applying the high logic voltage level to the deasserted backplanes of the N backplanes, applying the high logic voltage level to the asserted ones of the plurality of segments, and applying the low logic voltage level to the deasserted ones of the plurality of segments;

f) during a sixth phase having the second time period, applying the high logic voltage level to the asserted backplane i of the N backplanes, applying the high logic voltage level to the deasserted backplanes of the N backplanes, applying the high logic voltage level to the asserted ones of the plurality of segments, and applying the high logic voltage level to the deasserted ones of the plurality of segments; and g) incrementing i by 1 then repeating steps a) through f) until i=N.

41. The method of claim 40, wherein the steps a) through h) are performed in an order that minimizes direct current (DC) voltage bias between the plurality of segments and N backplanes.

42. The method of claim 40, further comprising the step of adjusting contrast of the plurality of segments by varying the second time period in relation to the first time period.

43. The method of claim 40, further comprising the step of adjusting LCD biasing according to a temperature of said LCD.

44. The method of claim 5, wherein the steps a) through h) are performed in an order that minimizes direct current (DC) voltage bias between the plurality of segments and N backplanes.

45. The method of claim 5, further comprising the step of adjusting contrast of the plurality of segments by varying the second time period in relation to the first time period.

46. The method of claim 5, further comprising the step of adjusting LCD biasing according to a temperature of said LCD.

* * * * *